US008652745B2

(12) United States Patent
Schuck et al.

(10) Patent No.: US 8,652,745 B2
(45) **Date of Patent: *Feb. 18, 2014**

(54) INK TONER PARTICLES WITH CONTROLLED SURFACE MORPHOLOGY

(75) Inventors: Ronald W. Schuck, Doylestown, PA (US); Charles B. Rybny, Doylestown, PA (US); Choung Lai, Doylestown, PA (US)

(73) Assignee: Penn Color, Inc., Doylestown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/554,437

(22) Filed: Jul. 20, 2012

(65) Prior Publication Data

US 2013/0045441 A1 Feb. 21, 2013

Related U.S. Application Data

(63) Continuation-in-part of application No. 12/672,208, filed as application No. PCT/US2009/031109 on Jan. 15, 2009, now Pat. No. 8,247,155.

(60) Provisional application No. 61/021,504, filed on Jan. 16, 2008.

(51) Int. Cl.
*G03G 5/00* (2006.01)

(52) U.S. Cl.
USPC ..... 430/137.1; 430/137.14; 430/137.17

(58) Field of Classification Search
USPC ..... 430/137.1, 137.14, 137.17
See application file for complete search history.

(56) References Cited

U.S. PATENT DOCUMENTS

| | | | |
|---|---|---|---|
| 3,422,049 | A | 1/1969 | McClain |
| 3,432,483 | A | 3/1969 | Peoples et al. |
| 3,449,291 | A | 6/1969 | Lerman et al. |
| 3,468,986 | A | 9/1969 | Watanabe |
| 3,505,434 | A | 4/1970 | Battaerd |
| 3,586,654 | A | 6/1971 | Lerman et al. |
| 3,622,555 | A | 11/1971 | Rothenbury et al. |
| 3,669,922 | A | 6/1972 | Bartsch et al. |
| 3,674,736 | A | 7/1972 | Lerman et al. |
| 3,746,681 | A | 7/1973 | McClain |
| 3,972,865 | A | 8/1976 | McClain et al. |
| 4,027,079 | A | 5/1977 | McClain et al. |
| 4,100,335 | A | 7/1978 | McClain et al. |
| 4,104,453 | A | 8/1978 | Broering et al. |
| 4,148,766 | A | 4/1979 | McClain |
| 4,148,768 | A | 4/1979 | McClain |
| 4,150,003 | A | 4/1979 | McClain et al. |
| 4,151,133 | A | 4/1979 | McClain |
| 4,200,601 | A | 4/1980 | McClain |

(Continued)

*Primary Examiner* — Stewart Fraser
(74) *Attorney, Agent, or Firm* — Stradley Ronon Stevens & Young, LLP

(57) ABSTRACT

The present invention provides a process for producing a colored toner having a textured surface, the process includes forming a polymer composition of at least one polymer and a colorant, where the at least one polymer has a softening temperature from about 60° C. to about 160° C.; forming an aqueous mineral suspension of at least one multivalent metal phosphate; forming a dispersion by combining the polymer composition and the aqueous mineral suspension under agitation to form a solid portion comprising dispersed particles of the polymer composition; heating the dispersion to a temperature above a glass transition temperature (Tg) of the polymer composition and increasing the pH to above 7.0; cooling the dispersion including the dispersed particles of the polymer composition to a temperature of from about 1° C. to about 89° C.; and recovering the particles.

19 Claims, 5 Drawing Sheets

(56) References Cited

U.S. PATENT DOCUMENTS

| | | | | |
|---|---|---|---|---|
| 4,208,528 | A | 6/1980 | McClain | |
| 4,212,966 | A | 7/1980 | McClain | |
| 4,252,969 | A | 2/1981 | Broering et al. | |
| 4,254,207 | A | 3/1981 | Landoll et al. | |
| 4,267,310 | A | 5/1981 | Landoll | |
| 4,287,333 | A | 9/1981 | McClain | |
| 4,329,304 | A | 5/1982 | McClain | |
| 4,329,305 | A | 5/1982 | McClain | |
| 4,336,210 | A | 6/1982 | McClain | |
| 4,403,068 | A | 9/1983 | McClain | |
| 4,440,908 | A | 4/1984 | McClain | |
| 4,610,944 | A | 9/1986 | Matsumoto et al. | |
| 4,833,060 | A | 5/1989 | Nair et al. | |
| 4,863,646 | A | 9/1989 | Watanabe et al. | |
| 5,185,229 | A | 2/1993 | Sato et al. | |
| 5,283,150 | A | 2/1994 | Tyagi et al. | |
| 5,300,386 | A | 4/1994 | Kanbayashi et al. | |
| 5,418,108 | A | 5/1995 | Kmiecik-Lawrynowicz et al. | |
| 5,472,649 | A | 12/1995 | Chang et al. | |
| 5,529,876 | A | 6/1996 | Sasaki et al. | |
| 5,556,732 | A | 9/1996 | Chow | |
| 5,658,704 | A | 8/1997 | Patel et al. | |
| 5,763,130 | A | 6/1998 | Sasaki et al. | |
| 5,780,196 | A | 7/1998 | Fujiwara et al. | |
| 5,843,614 | A | 12/1998 | Shinzo et al. | |
| 6,054,244 | A | 4/2000 | Kato et al. | |
| 6,287,742 | B1 | 9/2001 | Yoon | |
| 6,340,549 | B1 | 1/2002 | Maehata et al. | |
| 6,436,599 | B1 | 8/2002 | Matsuoka et al. | |
| 6,531,255 | B2 | 3/2003 | Kim et al. | |
| 6,558,864 | B2 | 5/2003 | Ishiyama et al. | |
| 6,582,867 | B2 | 6/2003 | Serizawa et al. | |
| 6,821,703 | B2 | 11/2004 | Uno et al. | |
| 6,864,029 | B2 | 3/2005 | Hamano et al. | |
| 7,074,541 | B2 | 7/2006 | Yamashita et al. | |
| 7,241,548 | B2 | 7/2007 | Sugiyama et al. | |
| 8,247,155 | B2 * | 8/2012 | Lai et al. | 430/137.1 |
| 2006/0046178 | A1 | 3/2006 | Akiyama et al. | |
| 2006/0099529 | A1 | 5/2006 | Tanaka et al. | |
| 2006/0216627 | A1 | 9/2006 | Mizutani et al. | |
| 2006/0292476 | A1 * | 12/2006 | Maehata et al. | 430/109.4 |
| 2006/0292479 | A1 | 12/2006 | Burkum | |
| 2007/0042286 | A1 | 2/2007 | Vanbesien et al. | |
| 2007/0065746 | A1 * | 3/2007 | Kawase et al. | 430/110.3 |
| 2007/0092821 | A1 | 4/2007 | Sato et al. | |
| 2007/0128537 | A1 * | 6/2007 | Ariyoshi et al. | 430/137.1 |
| 2007/0148576 | A1 | 6/2007 | Ishiyama et al. | |
| 2007/0202433 | A1 | 8/2007 | Matsumoto et al. | |
| 2007/0275316 | A1 | 11/2007 | Ishikawa et al. | |

* cited by examiner

INK TONER PARTICLES WITH CONTROLLED SURFACE MORPHOLOGY

CROSS REFERENCE TO RELATED APPLICATIONS

This application is a continuation-in-part of U.S. patent application Ser. No. 12/672,208 filed Feb. 4, 2010 now U.S. Pat. No. 8,247,155, which is the U.S. National Stage/Phase of International Patent Application No. PCT/US2009/031109 filed Jan. 15, 2009, which claims the benefit of priority under 35 U.S.C. §119(e) to U.S. Provisional Patent Application No. 61/021,504 filed Jan. 16, 2008, the entire disclosures of which are incorporated by reference herein for all purposes.

BACKGROUND OF THE INVENTION

This invention relates to a process for producing a colored toner to be used in electrophotography, electrostatic recording, electrostatic printing or toner-jet recording printing operations. More particularly, the invention provides a melt-dispersion process for producing a colored toner wherein the toner comprises particles of a controlled particle size and a narrow particle size distribution.

Electrophotography is a process that employs a photoconductive material to form an image by forming an electrostatic latent image on a photosensitive member by various means, subsequently developing the electrostatic latent image by the use of a toner to form a toner image, transferring the toner image to a recording medium such as paper as the occasion arises, and thereafter fixing the toner image by the action of heat, pressure or solvent vapor. As methods for developing the electrostatic image by the use of toners or methods for fixing the toner image, a variety of methods have been proposed, and methods suited for the respective image forming processes are employed. In recent years, higher-speed copying, higher image quality and color image formation are required for electrophotography. This has placed a demand in the art for developing colored toners that can perform satisfactorily in such processes.

The toner used in electrophotography applications typically comprises a colorant (which includes the color black) dispersed in a resin having a binding property referred to as a binder resin and, optionally, contains various additives such as a charge controller. In use, the toner is typically charged by triboelectric charging and supplied while being carried on a developing roller or the like to the surface of the photoreceptor.

One method of producing toners is by melt-kneading colorants such as dyes and pigments into thermoplastic resins to effect uniform dispersion, followed by pulverization and classification using a fine grinding mill and a classifier, respectively, to produce toners having the desired particle diameters. According to the pulverization process, an admixture of toner raw materials such as binder resin and a colorant is melt-kneaded, and a melt-kneaded product thus obtained is cooled down to be solidified, followed by pulverization and classification, in a consequence whereof a toner is obtained. The diameter-reduced toner manufactured by the pulverization method contains particles of which shapes are not uniform, and has extremely deteriorated powder flowability. When such a toner is used, the toner is unevenly charged before supplied to an electrostatic latent image, for example, which possibly generates unevenness in density or color of an image being formed.

Other drawbacks of the pulverization process include a limit to the range in which toner materials are selected. For example, colorant-dispersed resin materials must be brittle enough to be pulverizable with ease by means of an economically usable production apparatus. Since the colorant-dispersed resin materials must be made brittle to meet such a requirement, a group of particles having a broad particle size distribution tends to be formed when such a resin material is actually pulverized at a high speed, especially causing a problem that extremely fine particles having been pulverized excessively are included in this group of particles in a relatively large proportion. Such highly brittle materials tend to be further finely pulverized or powdered when used actually for the development in copying machines or the like.

In addition, the resolution, solid-area uniformity and gradation reproducibility of images formed by toners commonly depends on the properties of toners, especially their particle diameter, in a large proportion, where the use of toners with a smaller particle diameter brings about images with higher quality. Accordingly, recently developed printers and high-grade copying machines perform better with toners having a small particle diameter; however, in making toner particles having a smaller particle diameter by the pulverization process, the cost of pulverization would increase exponentially while the classification yield would be reduced precipitously, which makes the conventional production method cost prohibitive.

To overcome problems associated with the pulverization process, various toner production processes have evolved through the years. One method is a suspension polymerization method wherein a monomer mixture, most commonly a mixture of styrene monomer, acrylic monomers, a polymerization initiator, a colorant, and other ingredients are evenly mixed into an organic liquid phase, followed by dispersing the organic liquid phase in aqueous media and polymerizing the organic liquid phase. A significant drawback of this method is that the binder resin is limited to vinylic polymers such as polystyrene-acrylate copolymers, which can be manufactured by radical polymerization. The toner containing the vinylic polymer as binder resin is limited in printing performances such as high speed fusing properties and color chromaticity.

Another method is emulsion agglomeration method wherein a polymer colloid and a pigment colloid are mixed together, then induce the mixture to go through a controlled coagulation to form agglomerated particles to obtain a toner. The drawback of this method is that the binder colloid is limited to polystyrene-acrylate copolymers, and the composition of each toner particle tends to have large variation.

Yet another method is solvent dispersion method wherein a binder resin is dissolved in a water immiscible organic solvent solution containing dispersed colorant and other ingredients, then disperse the organic solution in water with the aid of a dispersant, followed by removal of the organic solvent to obtain a dispersion of toner particles in water, followed by washing and drying. The method allows the use of a broader choice of binder resins including the more desirable polyester resin. However, a significant drawback of this method is the employment of a substantial amount of organic solvent which is environmentally undesirable. Furthermore, it is difficult to completely remove the solvent from the toner particles.

A method that avoids much of the above drawbacks is the melt dispersion process in which a molten mixture comprising binder resin and colorant is dispersed under agitation in water in the presence of a dispersant. The types of dispersants employed in the prior art vary. For example, U.S. Pat. No. 3,669,922 discloses a process that comprises a controlled heating, melting, and dispersion of a polymer in the presence of water and a nonionic surfactant; U.S. Pat. No. 3,422,049 discloses a process that comprises a controlled heating, melting, and dispersion of a polymer in the presence of water and a block copolymer of ethylene oxide and propylene oxide; U.S. Pat. No. 4,440,908 discloses a process that comprises a controlled heating, melting, and dispersion of a polymer in the presence of water and a dispersing amount of a substantially water insoluble ionomer polymer such as, for example, polyethylene; U.S. Pat. No. 4,610,944 discloses a process that comprises a controlled heating, melting, and dispersion of a polymer in the presence of water and fine powdery inorganic particles; and U.S. patent application Publication No. 2007/0202433 discloses a process of manufacturing a toner comprising granulating by applying a shearing force and a collision force to a kneaded product of toner raw material containing binder resin and a colorant in water under heat and pressure and in the presence of a water-soluble polymer dispersant such as, for example, one or more water-soluble polymeric dispersants selected from polyoxyalkylene alkylarylether sulfate salt and polyoxyalkylene alkylether sulfate salt. In such prior art methods, however, it is difficult to achieve particle sizes below 12 μm with a narrow size distribution, which are needed to achieve the printing definition and resolution demanded by the current state of the art of printers and copiers. Moreover, the process described in U.S. patent application Publication No. 2007/0202433 employs a large amount of water-soluble polymeric dispersant which is often difficult to remove in the final product even by a subsequent washing process, thus, charge characteristics of the toner particles vary widely with the residual level and the type of the dispersants used. Accordingly there is a need in the art for a process for producing toner that does not suffer from the drawbacks associated with the prior art processes.

BRIEF SUMMARY OF THE INVENTION

The present invention provides a melt dispersion process for producing a colored toner having a volume average particle size preferably below 12 μm, and a particle size distribution of less than 1.4 such that the resultant toner is effective to achieve the printing definition and resolution demanded by the current state of the art of printers and copiers. Water-soluble dispersants and organic solvents are not employed in the method of the present invention. The particle size distribution as stated herein is a ratio of the volume average particle size (Pv) and number average particle size (Pn) of the toner particles. A ratio Pv/Pn=1 indicates an ideal mono-particle size distribution. The particles may be substantially spherical in shape and may comprise a smooth or textured surface.

Accordingly, in one aspect, the present invention provides a process for producing a colored toner comprising: forming a polymer composition comprising at least one polymer and a colorant, wherein the at least one polymer has a softening temperature from about 60° C. to about 160° C.; forming an aqueous mineral suspension of at least one multivalent metal phosphate; forming a dispersion by combining the polymer composition and the aqueous mineral suspension under agitation to form a solid portion comprising dispersed particles of the polymer composition, wherein the temperature of the aqueous mineral suspension during the dispersion is at least about 70° C.; heating the dispersion to a temperature above a glass transition temperature (Tg) of the polymer composition and increasing the pH to above 7.0; cooling the dispersion comprising the dispersed particles of the polymer composition to a temperature of from about 1° C. to about 89° C.; and recovering the particles. These particles may be substantially spherical in shape and may comprise a textured or roughened surface morphology. For example, the particles may comprise an average surface roughness, $R_a$, of about 15 to 55 nm.

In another aspect, the present invention provides a process for producing a colored toner comprising the steps of: providing a polymer composition comprising at least one polymer wherein the at least one polymer has a softening temperature from about 30° C. to about 160° C.; and a colorant; forming an aqueous mineral suspension of at least one multivalent metal phosphate by adding a water-soluble salt of the multivalent metal into an aqueous solution comprising: (1) a water-soluble phosphate salt; and (2) at least one crystal growth inhibitor selected from the group consisting of: an organic polycarboxylic acid or a salt there of, a pyrophosphate salt, phosphonic acid or a salt thereof, citric acid, L-Serine, 1,2-dihydroxy-1,2-bis(dihydroxyphosphonyl) ethane, and a $Zn^{2+}$ salt, to precipitate the at least one multivalent metal phosphate, wherein the pH of the resultant aqueous mineral suspension is from 5.5 to 14; forming a dispersion of the polymer composition by adding the polymer composition to the aqueous mineral suspension under agitation to form a solid portion comprising dispersed particles of the polymer composition, wherein the temperature of the aqueous mineral suspension during the dispersing step is at least about 70° C.; cooling the aqueous mineral suspension comprising the dispersed particles of the polymer composition to a temperature of from about 1° C. to about 89° C.; washing the particles; and recovering the particles. These particles may be substantially spherical in shape and may comprise a smooth surface morphology.

In another aspect, the present invention provides a process for producing a colored toner comprising the steps of: providing a polymer composition comprising at least one polyester polymer having a softening temperature from about 30° C. to about 160° C.; and a colorant; forming an aqueous mineral suspension of at least one of a calcium phosphate and a magnesium phosphate by adding a water soluble salt of at least one of calcium or magnesium into an aqueous solution comprising: a water soluble phosphate salt; and at least one crystal growth inhibitor selected from the group consisting of: an organic polycarboxylic acid or a salt there of, a pyrophosphate salt, phosphonic acid or a salt thereof, citric acid, L-Serine, 1,2-dihydroxy-1,2-bis(dihydroxyphosphonyl) ethane, and a $Zn^{2+}$ salt, to precipitate the at least one of a calcium phosphate and a magnesium phosphate, wherein the pH of the aqueous mineral suspension is from 7 to 12; heating the at least one multivalent metal phosphate at a temperature of from about 90° C. to about 100° C. for from about 10 to about 20 minutes; dispersing the polymer composition by adding the polymer composition to the aqueous mineral suspension under agitation to form a solid portion comprising dispersed particles of the polymer composition, wherein the temperature of the aqueous mineral suspension during the dispersing step is at least about 70° C.; cooling the aqueous mineral suspension comprising the dispersed particles of the polymer composition to a temperature of from about 1° C. to about 89° C.; washing the particles; and recovering the particles, wherein the volume average particle size of the particles is less than 12 μm, and particle size distribution is less than 1.4.

In yet another aspect, a given surface morphology (e.g., smooth or textured) may be achieved by using a method of producing a colored toner comprising: forming a polymer composition comprising at least one polymer and a colorant, wherein the at least one polymer has a softening temperature from about 60° C. to about 160° C.; forming an aqueous mineral suspension of at least one multivalent metal phosphate; forming a dispersion by combining the polymer composition and the aqueous mineral suspension under agitation to form a solid portion comprising dispersed particles of the polymer composition, wherein the temperature of the aqueous mineral suspension during the dispersion is at least about 70° C.; and either:

(i) heating the dispersion to a temperature above a glass transition temperature (Tg) of the polymer composition and adjusting the pH of the dispersion to be basic; cooling the dispersion comprising the dispersed particles of the polymer composition to a temperature of from about 1° C. to about 89° C.; and recovering particles comprising a textured surface; or (ii) heating the dispersion to a temperature, preferably, above a glass transition temperature (Tg) of the polymer composition and adjusting the pH of the dispersion to be acidic; cooling the dispersion comprising the dispersed particles of the polymer composition to a temperature of from about 1° C. to about 89° C.; and recovering particles comprising a smooth surface.

BRIEF DESCRIPTION OF SEVERAL VIEWS OF THE DRAWINGS

The invention may be best understood from the following detailed description when read in connection with the accompanying drawing. Included in the drawing are the following figures.

DETAILED DESCRIPTION OF THE INVENTION

Providing the Polymer Composition (Melt Kneading)

Figure 1:
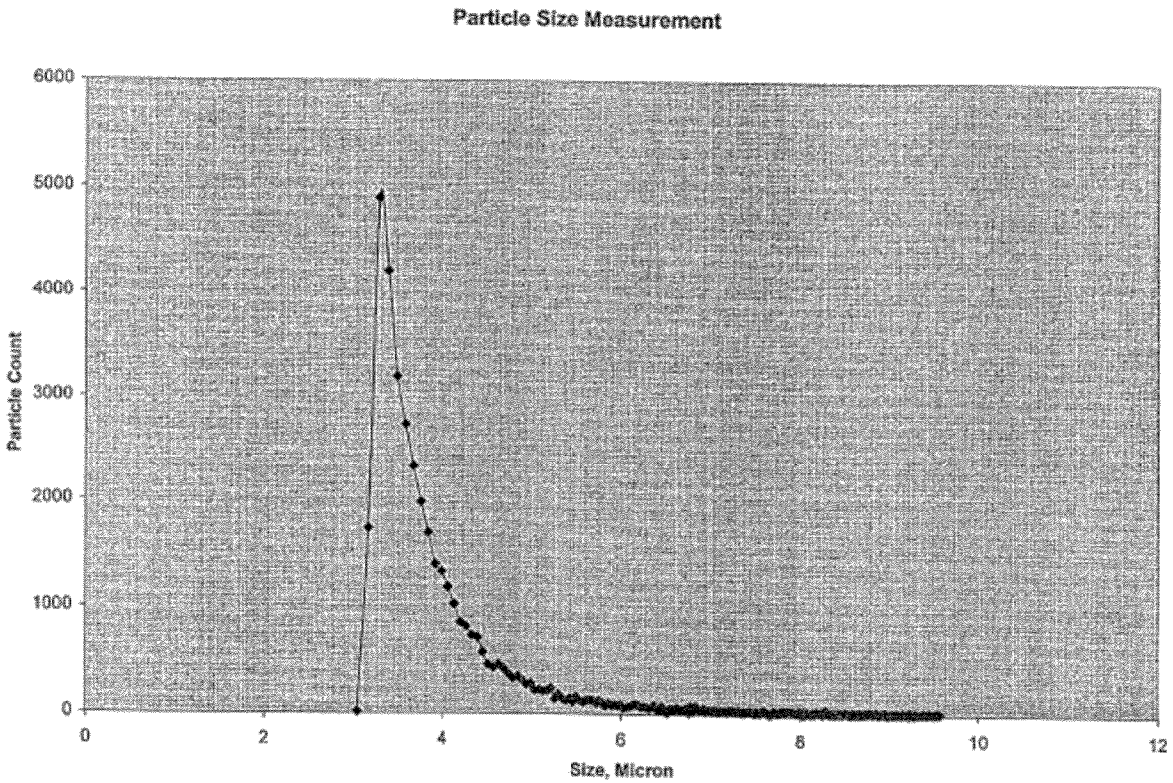
FIG. 1 is a graph illustrating a particle size measurement of toner particles produced according to an embodiment of the present invention.

The process of the present invention includes the step of providing a polymer composition comprising at least one polymer (also referred to herein as a "binder resin") wherein the at least one polymer has a softening temperature from about 30° C. to about 160° C.; and a colorant. In preferred embodiments, this includes a melt kneading step to form a polymer composition comprising at least a binder resin (i.e., polymer) and a colorant. The binder resin and the colorant (and other components if present) are melt kneaded to prepare a kneaded resin product. The melt kneading is kneading conducted substantially without the use of an organic solvent, however, small amounts of an organic liquid (including an organic solvent) may be present as a process aid to, for example, control dusting of the polymer. The kneaded polymer composition may optionally contain additives, for example, a releasing agent such as wax and an additive such as a charge controller. The additives are kneaded together with the binder resin and the colorant and dispersed in the kneaded polymer composition.

(a) Binder Resin

As the binder resin, the selection of ingredients is not particularly limited as long as the ingredient can be melt dispersed in its molten state. Examples of suitable binder resins include polyester, acrylic resin, a styrene-acrylic acid copolymer resin, polyurethane, and epoxy resin. Optionally, the binder resin can be modified to contain a small amount of gel content.

Suitable polyesters include a polycondensation of a polybasic acid and a polyhydric alcohol. Suitable polybasic acids include aromatic carboxylic acids, and aliphatic carboxylic acids. Suitable aromatic carboxylic acids include aromatic dicarboxylic acids such as an aromatic dicarboxylic acid, for example, terephthalic acid, isophathalic acid, or naphthalene dicarboxylic acid, and acid anhydride (for example, phthalic acid anhydride) or esterification product thereof, and tri- or higher basic aromatic carboxylic acids, for example, a tri- or higher basic aromatic carboxylic acid such as trimellitic acid (benzene-1,2,4-tricarboxylic acid), trimesinic acid (benzene-1,3,5-tricarboxylic acid), naphthalene-1,2,4-tricarboxylic acid, naphthalene-2,5,7-tricarboxylic acid, or pyrromellitic acid (benzene-1,2,4,5-tetracarboxylic acid), and acid anhydride (for example, trimellitic acid anhydride) or esterification product thereof. Aliphatic carboxylic acids include aliphatic dicarboxylic acids such as an aliphatic dicarboxylic acid, for example, maleic acid, fumaric acid, succinic acid, or adipic acid, and acids anhydride (for example, maleic acid anhydride and alkenyl succinic acid anhydride), or esterification product thereof. The alkenyl succinic acid anhydride comprises various kinds of olefins with addition of maleic acid anhydride, and specific examples thereof include, for example, hexadecenyl succinic acid anhydride, heptadecenyl succinic acid anhydride, octadecenyl succinic acid anhydride, tetrapropenyl succinic acid anhydride, dodecenyl succinic acid anhydride, triisobuteny succinic acid anhydride, or 1-methyl-2-pentedecenyl succinic acid anhydride. The polybasic acids can be used each alone, or two or more of them can be used together. Optionally, the polyesters can be made to contain a small amount of gel content by adding a small amount of multifunctional co-monomers during the polymerization process. In certain embodiments of the present invention, the polyester has a gel content from about 0.1% to 10%.

Suitable polyhydric alcohols include aliphatic polyhydric alcohols and aromatic polyhydric alcohols. The aliphatic polyhydric alcohols include aliphatic diols, such as ethylene glycol, propylene glycol, butane diol, hexane diol, and neopentyl glycol, cycloaliphatic polyhydric alcohols such as cyloalipahtic diols, for example, cyclohexane diol, cyclohexane dimethanol, or hydrogenated bisphenol A, and tri- or higher hydric aliphatic polyhydric alcohols such as glycerine (glycerol), sorbitol, 1,4-sorbitan, 1,2,3,6-hexane tetraol, pentaerythritol, dipentaerythritol, tripentaerythritol, 1,2,4-butane triol, 1,2,5-pentane triol, 2-methylpropane triol, 2-methyl-1,2,4-butane triol, trimethylol ethane, or trimethylol propane. Suitable aromatic polyhydric alcohols include aromatic diols such as bisphenol A or derivatives thereof such as, for example, bisphenol A alkylene oxide adducts such as, for example, bisphenol A ethylene oxide adduct, or bisphenol A propylene oxide adduct, and tri- or higher aromatic polyhydric alcohols such as 1,3,5-trihydroxybenzene. Bisphenol A is 2,2-bis(p-hydroxyphenyl)propane, and the bisphenol A ethylene oxide adduct includes, for example, polyoxyethylene-2,2-bis(4-hydroxyphenyl)propane, and the bisphenol A propylene oxide adduct includes, for example, polyoxypropylene-2,2-bis(4-hydroxyphenyl)propane. The polyhydric alcohols can be used each alone, or two or more of them can be used together.

Polycondensation reaction of polybasic acid and polyhydric alcohol can be effected by methods known to those skilled in the art. For example, the polycondensation reaction can be effected by contacting polybasic acid and polyhydric alcohol each other in the presence or absence of an organic solvent and in the presence of a polycondensation catalyst, and terminated at the instant when the acid value and the softening temperature of the resultant polyester stand at predetermined values. In the case of using the methyl-esterified compound of polybasic acid as a part of polybasic acid, a de-methanol polycondensation reaction takes place. In the polycondensation reaction, by properly changing the blending ratio, the reaction rate, or other factors as to the polybasic acid and the polyhydric alcohol, it is possible to adjust, for example, the terminal carboxyl group content of polyester and thus denature a property of the resultant polyester. Further, in the case of using trimellitic anhydride as polybasic acid, the denatured polyester can be obtained also by facile introduction of a carboxyl group into a main chain of polyester.

Suitable acrylic resins include an acid group-containing acrylic resin. The acid group-containing acrylic resin can be produced, for example, by polymerization of acrylic resin monomers or polymerization of acrylic resin monomer and vinylic monomer with concurrent use of acidic group- or hydrophilic group-containing acrylic resin monomer and/or acidic group- or hydrophilic group-containing vinylic monomer. Suitable acrylic resin monomers include acrylic acid, methacyrlic acid, acrylate monomer such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate or dodecyl acrylate, and methacrylate monomer such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, or dodecyl methacrylate. The acrylic monomer may have a substituent such as, for example, an acrylate ester monomer or methacrylate ester monomer having a hydroxyl group such as hydroxyethyl acrylate or hydroxypropyl methacrylate. The acrylic monomers can be used each alone or two or more of them can be used together. Suitable vinylic monomers include aromatic vinyl monomers such as styrene and α-methylstyrene, aliphatic vinyl monomers such as vinyl bromide, vinyl chloride, or vinyl acetate, and acrylonitrile monomers such as acrylonitrile and methacrylonitrile. The vinylic monomers can be used each alone or two or more of them can be used together. The polymerization is typically effected by use of a commonly-used radical initiator in accordance with a solution polymerization method, a suspension polymerization method, an emulsification polymerization method, or the like method.

Suitable styrene-acrylate copolymer resins include those made by copolymerization of a mixture of styrenic monomers, acrylic monomers, methacrylic monomers, and optionally a small amount of multifunctional monomers to impart gel content, and other co-monomers. Examples of styrenic monomers include styrene, α-methylstyrene, o-methyl styrene, m-methyl styrene, p-methyl styrene, p-methoxystyrene, divinylbenzen; examples of acrylate monomer include acrylic acid, methyl acrylate, ethylacrylate, n-propylacrylate, n-butylacrylate, isobutylacrylate, 2-ethylhexylacrylate, n-octylacrylate, dodecylacrylate, stearylacrylate, hydroxyethylacrylate, hydroxypropylacrylate, ethylenediacrylate, butylenediacrylate, trimethylolpropanetriacrylate. Examples of methacrylate monomers include methacrylic acid, methyl methacrylate, ethyl methacrylate, propyl methacrylate, n-butyl methacrylate, isobutyl methacrylate, octyl methacrylate, 2-ethylhexyl methacrylate, hydroxyethyl methacrylate, hydroxypropyl methacrylate, allyl methacrylate, ethyldimethacrylate, butyldimethacrylate, hexyldimethacrylate.

Suitable polyurethane resins include an acidic group- or basic group-containing polyurethane. The acidic group- or basic group-containing polyurethane can be produced in accordance with any method known in the art, for example, by subjecting acidic group- or basic group-containing diol, polyol, and polyisocyanate to an addition polymerization. Examples of the acidic group- or basic group-containing diol include dimethylol propionic acid and N-methyl diethanol amine. Examples of the polyol include polyether polyol such as polyethylene glycol, and polyester polyol, acryl polyol, and polybutadiene polyol. Examples of the polyisocyanate include tolylene diisocyanate, hexamethylene diisocyanate, and isophorone diisocyanate. These components may be used each alone or two or more of the components may be used in combination.

Suitable epoxy resins include a bisphenol A epoxy resin synthesized from bisphenol A and epichlorohydrin, a phenol novolac epoxy resin synthesized from phenol novolac as a reaction product of phenol and formaldehyde, and epychlorohydrin, and a cresol novolac epoxy resin synthesized from cresol novolac as a reaction product of cresol and formaldehyde and epichlorohydrin. Among them, epoxy resins having acidic group or basic group are preferred. An epoxy resin having acidic group or basic group can be prepared, for example, by using the epoxy resin described above as a base and adding or addition polymerizing a polybasic carboxylic acid such as adipic acid or trimellitic acid anhydride, or an amine such as dibutylamine or ethylene diamine to the epoxy resin as the base.

Among these binder resins, a polyester and/or a resin blend that includes a polyester is preferred. Polyesters are typically excellent in transparency and capable of providing toner particles with favorable powder flowability, low-temperature fixing property and secondary color reproducibility. Moreover, resins having a softening temperature of 160° C. or lower, and particularly preferable to use binder resin having a softening temperature of from 60° C. to 160° C. are preferred. As used herein, the term "softening temperature" refers to the temperature at which a material transforms a specific amount when measuring it under specific examination conditions. For example, a standard test know to those skilled in the art and preferred for measuring softening temperature in accordance with the present invention employs a Shimatsu Flowtester CFT-500 (Shimatsu Corporation, Kyoto, Japan) wherein the softening temperature of a polymer is identified as the temperature at which 4 millimeters of the sample flows out of a nozzle. Exemplary examination conditions of the Shimatsu Flowtester CFT-500 instrument are: nozzle size=1 mm in diameter by 10 mm in length; plunger=1 $cm^2$; load=30 Kgf; heating rate=3° C./minute; and sample size=1 gram. Among such binder resins, preferred is a binder resin of which weight-average molecular weight falls in a range of from 5,000 g/mol to 500,000 g/mol. The binder resins may be used each alone or two or more of the binder resins may be used in combination. Furthermore, it is possible to use a plurality of resins of the same type, which are different in any one or all of molecular weight, monomer composition, and other factors.

(b) Colorant

Suitable colorants to be mixed with the binder resin include any of the organic dyes, organic pigments, inorganic dyes and inorganic pigments that are typically used as colorants in toner applications. Examples of such colorants include the following colorants of respective colors to be shown below. In the following, the designation "C.I." means color index.

A black colorant includes, for example, carbon black, copper oxide, manganese dioxide, aniline black, activated carbon, non-magnetic ferrite, magnetic ferrite, and magnetite.

A yellow pigment includes, for example, C.I. pigment yellow 13, C.I. pigment yellow 14, C.I. pigment yellow 17, C.I. pigment yellow 74, C.I. pigment yellow 93, C.I. pigment yellow 155, C.I. pigment yellow 180, and C.I. pigment yellow 185.

An orange colorant includes, for example, red chrome yellow, molybdenum orange, permanent orange GTR, pyrazolone orange, vulcan orange, indathrene brilliant orange RK, benzidine orange G, indathrene brilliant orange GK, C.I. pigment orange 31, C.I. pigment orange 43.

A red colorant includes, for example, C.I. pigment red 52, C.I. pigment red 53, C. I. pigment violet 19, C.I. pigment red 48:1, C.I. pigment red 48:2, C.I. pigment red 48:3, C. I. pigment red 57:1, C.I. pigment red 122, C.I. pigment red 150, and C.I. pigment red 184.

A purple colorant includes, for example, C.I. pigment violet 23, manganese purple, fast violet B, and methyl violet lake.

A blue colorant includes, for example, C.I. pigment blue 15, C.I. pigment blue 15:2, C.I. pigment blue 15:3, C.I. pigment blue 15:4, C.I. pigment blue 16, and C.I. pigment blue 60.

A green colorant includes, for example, chromium green, chromium oxide, pigment green B, micalite green lake, final yellow green G, and C.I. pigment green 7.

A white colorant includes compound, for example, zinc powder, titanium dioxide, antimony white, and zinc sulfide.

The colorants can be used each alone or two or more of them of different colors can be used together. A plurality of colorants of an identical color system can also be used together. The ratio of the colorant used to the binder resin is not particularly restricted and can be properly selected within a wide range in accordance with various conditions such as the type of binder resin and the colorant, the characteristics required for the toner particles to be obtained. As an example, the ratio of the colorant used to the binder resin can be preferably from 0.1 part by weight or 20 parts by weight or less, and more preferably, 5 parts by weight or more and 15 parts by weight or less based on 100 parts by weight of the binder resin.

(c) Additives

The polymer resin composition may optionally further include in addition to the binder resin and the colorant, additives that are typically employed in toners such as, for example, a releasing agent such as a wax and a charge controller. Although optional, the polymer resin preferably includes the wax. Suitable waxes include, for example, natural waxes such as carnauba wax and rice wax, synthetic waxes such as polypropylene wax, polyethylene wax, and Fischer-Tropsch wax, coal type waxes such as montan wax, petroleum waxes such as paraffin wax, alcohol type waxes, and ester type waxes. Such waxes can be used each alone or two or more of them can be used together.

Preferably, the melting point of the wax is between from about 60° C. to about 140° C. and, more preferably, between about 70° C. and about 120° C. By the use of the wax having the melting point in the range described above, the resultant toner typically exhibits excellent anti-hot offsetting and low temperature fixing characteristics. The melting point of the wax is the temperature at the top of a melting peak of a DSC (differential scanning calorimetry) curve.

Although the amount of the wax to be used is not particularly restricted and can be selected properly from a wide range in accordance with various conditions such as the kind of the binder resin, the colorant, the chemistry of the wax, and the characteristics required for the toner particles to be obtained, it is preferably between 5 and 10 parts by weight based on 100 parts by weight of the binder resin.

The charge controller can be any agent that is typically employed in the art as a charge controller such as, for example, calyx arenas, quaternary ammonium salt compounds, nigrosine compounds, organic metal complexes, chelate compounds, metal salts of salicylic acid such as zinc salicylate, and polymeric compounds obtained by homopolymerization or copolymereization of monomers having ionic groups such as sulfonic groups and amino groups. Such charge controllers may be used each alone or two or more of them may be used together. Although the amount of the charge controller is not particularly restricted and can be selected properly from a wide range in accordance with various conditions such as the kind of the binder resin, and the kind and the content of the colorant, it is preferably between from 0.5 to 5 parts by weight based on 100 parts by weight of the binder resin.

The polymer composition can be manufactured, for example, by dry mixing an appropriate amount of each of the binder resin and the colorant and, optionally, an appropriate amount of various kinds of additives such as the wax in a mixer, and melt kneading them by heating to a temperature higher than the softening temperature of the resin, preferably, a temperature higher than the softening temperature and lower than the heat decomposition temperature of the resin, specifically, about at a temperature, preferably, of between about 80 to about 200° C., more preferably, between about 100° C. and about 150° C. In this embodiment, the melt kneading is conducted substantially in the absence of an organic solvent (except for, as mentioned above, wherein small quantities of an organic liquid is employed as a process aid).

Any suitable mixer can be employed for the dry mixing such as, for example, a Henschel mixing apparatus (available from Henschel Industrietechnik GmbH). The kneading can be accomplished by any kneading apparatus typically employed in the art such as, for example, a single or twin screw extruder such as, for example, ZSE18 (manufactured by American Leistritz, Summerville, N.J.), ZSK-30 (trade name of products manufactured by Coperion Wener Pfleiderer GmbH, Stuttgart, Germany), and TSK-TT 020 (manufactured by Theysohn Extruder-Komponenten Salzgitter GmbH) and two roll mills such as Polymill (manufactured by Farrel Corporation, Ansonia, Conn.), and open roll kneading machines such as Kneadex (trade name of products manufactured by Mitsui Mining Co.) and thermoplastic dough kneading such as IP5 AP/T (trade name product manufactured by B&P Process Equipment. The dry kneading may also be conducted by using a plurality of kneading machines.

Forming an Aqueous Mineral Suspension

In the process of the present invention, the melt-dispersion is carried out in an aqueous medium containing a substantially water-insoluble phosphate salt of a multivalent metal (herein also referred to as the "phosphate dispersant"). As used herein the term "multivalent metal" refers to a metal ion having at least two empty electronic valences such as, for example, $Ca^{2+}$, $Mg^{2+}$, and $Al^{3+}$. As used herein, the term "substantially water-insoluble" means that the dispersant has a solubility in water that is less than 1 gram per 100 grams of water. As such, the phosphate dispersant used in the present invention is preferably a particulate matter. The phosphate dispersant functions to disperse the molten polymer composition in the aqueous medium. Suitable phosphate dispersants include calcium phosphate, hydroxylapatite, magnesium phosphate, aluminum phosphate, zinc phosphate, and mixtures thereof. Calcium and/or magnesium phosphates are the preferred phosphate dispersants.

The phosphate dispersant may be used in an amount adapted for giving a desired particle size and distribution selected from the range of from 0.01 to 30 parts, preferably 0.05 to 10 parts, per 100 parts of the polymer composition.

Without intending to be bound by any particular theory, it is believed that such dispersants prevent polymer particles from agglomerating during the melt dispersion process which are present in the form of droplets dispersed uniformly in the aqueous medium and further adsorb uniformly on the surfaces of these droplets to make the droplets stable. Because the size of the water-insoluble dispersant has a proportional effect on the size of particle of the dispersed polymer composition, it is preferred that the phosphate dispersant is formed in situ, to form smaller particles of the phosphate dispersant. Moreover, it is believed that phosphate dispersants formed at higher temperature are of larger size than those formed at lower temperature, and those formed at lower temperatures are inclined to grow in size upon heating. Thus, for temperatures typically experienced during a melt-dispersion operation, it has been difficult to control the volume average particle size of the dispersed polymer composition to below 12 microns using phosphate dispersants formed at a pH of between 5.5 and 14. The present inventors have surprisingly discovered that, by adding a small amount of crystal growth inhibitor to the aqueous media during the preparation of the aqueous mineral suspension of the multivalent metal phosphate, the resultant phosphate dispersants are able to disperse a molten polymer composition consistently into polymer particles of less than 12 microns with a narrow particle size distribution. As used herein, the term "crystal growth inhibitor" refers to a compound that inhibits the particle size growth rate of the phosphate dispersant; such term is not intended to be limited to inhibiting the growth of "crystal" forms of the phosphate dispersants only, but also includes amorphous forms of the phosphate dispersant. Without intending to be bound by a particular theory, it is speculated that, in addition to inhibiting the particle size growth of the phosphate dispersants, the "crystal growth inhibitor" may also influence the chemical composition and the crystal structure (i.e., the crystal shape) of the phosphate dispersant which may, in turn, assist in optimizing its effectiveness as a dispersant of the molten polymer composition and, hence, the size of the toner particles.

Suitable crystal growth inhibitors include, but are not limited to, an organic polycarboxylic acid, a pyrophosphate salt, phosphonic acid or a salt thereof, citric acid, L-Serine, 1,2-dihydroxy-1,2-bis(dihydroxyphosphonyl)ethane, and a $Zn^{2+}$ salt. Examples of suitable organic polycarboxylic acids include phthalic acid, isophthalic acid, terephthalic acid, melitic acid, citric acid, anhydrides, polyacrylic acid, and salts thereof. Examples of suitable $Zn^{2+}$ salts include zinc sulfate, zinc acetate, and zinc chloride. Preferred crystal growth inhibitors are the organic polycarboxylic acids such as phthalic acid, melitic acid, citric acid, and anhydrides thereof, and pyrophosphate salts such as, for example, sodium pyrophosphate and potassium pyrophosphate.

Preferably, the crystal growth inhibitor is present in the aqueous medium in an amount of from about 0.01 to about 200 weight percent based on the phosphate dispersant, more preferably from about 0.10 to about 100 weight percent based on the phosphate dispersant, and most preferably from about 1 to about 50 weight percent based on the phosphate dispersant.

In preferred embodiments of the present invention, the multivalent metal phosphate is formed in situ in an aqueous medium by contacting a water-soluble salt of the multivalent metal with an aqueous solution of a water-soluble phosphate salt and precipitating the at least one multivalent metal phosphate in the presence of at least one crystal growth inhibitor.

Examples of water-soluble salts of the multivalent metal include $CaCl_2$, $MgCl_2$, $FeCl_2$, $AlCl_3$, $ZnCl_2$, $BaCl_2$, $ZnSO_4$, $BaSO_4$, $MgSO_4$, $FeCl_3$, and mixtures thereof.

Examples of water-soluble phosphate salts include $Na_3PO_4$, $Na_3PO_4.12H_2O$, $K_3PO_4$, $NaH_2PO_4$, $Na_2HPO_4$, $KH2PO_4$, $K_2HPO_4$, and mixtures thereof.

Examples of the in situ reaction to produce the substantially water-insoluble phosphate dispersant include:

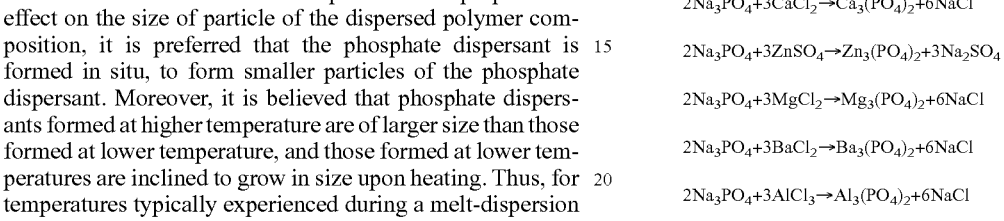

$$2Na_3PO_4+3CaCl_2 \rightarrow Ca_3(PO_4)_2+6NaCl$$

$$2Na_3PO_4+3ZnSO_4 \rightarrow Zn_3(PO_4)_2+3Na_2SO_4$$

$$2Na_3PO_4+3MgCl_2 \rightarrow Mg_3(PO_4)_2+6NaCl$$

$$2Na_3PO_4+3BaCl_2 \rightarrow Ba_3(PO_4)_2+6NaCl$$

$$2Na_3PO_4+3AlCl_3 \rightarrow Al_3(PO_4)_2+6NaCl$$

As the water-soluble phosphate solution, an aqueous sodium phosphate solution is preferred. The water-soluble salt of the multivalent metal may be added as an aqueous solution or in powder form to the water-soluble phosphate solution, or an aqueous solution of the water-soluble phosphate solution may be prepared and added to the water-soluble salt of the multivalent metal solution. Calcium or magnesium chloride is the preferred water-soluble salt of the multivalent metal.

When the multivalent metal phosphate is formed in situ in an aqueous medium by contacting a water-soluble salt of the multivalent metal with an aqueous solution of a water-soluble phosphate salt in the presence of at least one crystal growth inhibitor, the order of addition is not important. Thus, for example, such precipitation can occur when, for example, the water-soluble salt of the multivalent metal (or a solution thereof) is added to the aqueous solution of a water-soluble phosphate salt and the at least one crystal growth inhibitor or, alternatively, the water-soluble phosphate salt (or a solution thereof) may be added to an aqueous solution of the water-soluble salt of the multivalent metal and the at least one crystal growth inhibitor. In some embodiments of the present invention, the crystal growth inhibitor could also be added to the aqueous medium after the formation of the phosphate crystals.

The pH of the resultant aqueous mineral suspension is preferably from 5.5 to 14, and more preferably from 7 to 12. Additional base may be added to further basify the aqueous mineral suspension, if desired.

In preferred embodiments of the present invention, after it is formed (and prior to the introduction of the polymer melt) the multivalent metal phosphate is heated for a time period of from about 5 to about 60 minutes, more preferably at least from about 10 to about 20 minutes and, most preferably at least for about 15 minutes. During this step the multivalent metal phosphate is preferably heated to a temperature of from at least about 60° C. to about 100° C., more preferably from at least about 80° C. to about 100° C., still more preferably from at least about 90° C. to about 100° C., and most preferably from at least about 95° C. to about 100° C.

In preferred embodiments, the aqueous mineral suspension of at least one multivalent metal phosphate is formed by adding the water soluble salt of the multivalent metal into an aqueous solution of the water-soluble phosphate salt and the at least one crystal growth inhibitor under agitation to precipitate the at least one multivalent metal phosphate. Suitable agitation is provided by, for example, a Kady Lab Mill available from Kady International, Scarborough, Me.)), or a Ross series 100 mixer available from Charles Ross & Son Company, Hauppauge, N.Y.).

Optionally, the aqueous solution comprises a pH control agent. Suitable pH control agents include organic acids such as, for example, acetic acid, propionic acid, butyric acid, and phthalic acid; inorganic acids such as, for example, hydrochloric acid, sulfuric acid, and phosphoric acid; organic bases, such as, for example, ethyl amine, and triethyl amine; and inorganic bases such as, for example, sodium hydroxide, potassium hydroxide, and ammonium hydroxide. A pH control agent according to the present invention can also comprise a buffer.

Once the aqueous mineral suspension of at least one multivalent metal phosphate is formed according to the present invention, the melt dispersion step is performed as described below; however, to obtain an optimal toner, it is preferred that the total amount of the multivalent metal phosphate dispersant is present between about 0.01 to about 30 parts per 100 parts of the polymer composition. In some embodiments of the present invention, the multivalent metal phosphate is employed at a concentration of from about 0.1 to about 30% based on the polymer composition. In other embodiments of the present invention, the multivalent metal phosphate is employed at a concentration of from about 1 to about 15% based on the polymer composition. In yet other embodiments of the present invention, the multivalent metal phosphate is employed at a concentration of from about 2 to about 12% based on the polymer composition. In still other embodiments of the present invention, the multivalent metal phosphate is employed at a concentration of from about 5 to about 8% based on the polymer composition.

Dispersing the Melted Polymer Composition

The polymer composition is next brought into contact with the aqueous mineral suspension as described above and the temperature of the aqueous mineral suspension is increased to a temperature of at least about 70° C., preferably from about 90° C. to about 250° C., and more preferably from 90° C. to about 180° C., depending upon the softening temperature, melting point, melt flow properties, and decomposition temperature of the polymer component(s) of the polymer composition. In one embodiment of the present invention, the polymer composition is added to the aqueous mineral suspension as a dry polymer powder which then becomes molten in the heated aqueous mineral suspension. In another embodiment of the present invention, the polymer composition is in a molten state when it is pumped into the heated aqueous mineral suspension. While the foregoing can be dispersed at temperatures commencing with their respective melting point, increases in dispersion temperature beyond the melting point and up to the decomposition of the resins are generally accompanied by corresponding increases in the fluidity of the molten polymer. As the fluidity of the melt increases, the dispersions generally tend to develop lower average particle sizes without requiring increases in agitation effort.

The dispersing apparatus or device employed to disperse the polymer composition to form toner according to the process of the present invention may be any device capable of delivering at least a moderate amount of shearing action under elevated temperatures and pressures to a liquid mixture. Suitable, for example, are conventional autoclaves equipped with conventional rotor-stator mixers. The particle size and distribution are dependent on the stirring rate, high stirring speeds resulting in finer and narrower dispersions until an optimum speed is reached above which there is little change. In general, the rate of the rotor speed can vary from about 1,200 to about 15,000 rpm and preferably from about 1,800 to about 10,000 rpm. The stirring periods will typically range from about 1 to about 120 minutes and preferably from about 5 to about 60 minutes. It will be understood, however, that the stirring rates and periods will depend upon the type of equipment utilized.

The amount of water used in relation to the sum total of phosphate dispersant and polymer being dispersed generally ranges from about 0.1 to about 12.0 parts by weight of water per part of total normally solid polymer. Lower ratios, although usable, present operational difficulties. The preferred range is between about 1.0 to about 5.0 parts per part of polymer. The ratio of water to total resin solids typically has an effect on particle size and particle size distribution.

The pressure under which the process of the present invention is carried out is adjusted to exceed the vapor pressure of water at the operating temperature so as to maintain a liquid water phase. More particularly, the pressures may range from about 1 to 217 atmospheres, and preferably from about 1 to 5 atmospheres. In cases where the polymer is sensitive to air at the elevated dispersion temperature, an inert gas, e.g., nitrogen or helium, may be substituted for the air normally present, and deaerated water used. Plasticizers, lubricants, antioxidants, defoamers, and the like can also be included. Mixtures of polymers are also suitable for dispersion in accordance with the process of this invention.

During the melt dispersion step of the present invention, the particle size of the resultant toner is primarily controlled by the amount of the phosphate dispersant (e.g., $Ca_3(PO_4)_2$) and the crystal growth inhibitor in the aqueous mineral suspension.

The foregoing process is advantageously performed substantially without the use of organic solvents.

Particle Surface Morphology

An advantage of the present invention is that the surface morphology of the particles can be tailored or tuned to a desired surface morphology. In particular, the particles may be formed to have a textured or roughened surface morphology. Alternatively, the particles may be formed to have a smooth surface morphology.

(a) Textured or Roughened Surface Morphology

Once the dispersion is formed, a textured surface morphology may be obtained in the recovered particles by heating the dispersion to a temperature above the glass transition temperature (Tg) of the polymer composition and increasing the pH of the dispersion to a basic pH, for example, above 7.0, preferably above 9.0.

According to one aspect of the invention, a process for producing a colored toner having a textured or roughened surface morphology comprises: forming a polymer composition comprising at least one polymer and a colorant, wherein the at least one polymer has a softening temperature from about 60° C. to about 160° C.; forming an aqueous mineral suspension of at least one multivalent metal phosphate; forming a dispersion by combining the polymer composition and the aqueous mineral suspension under agitation to form a solid portion comprising dispersed particles of the polymer composition, wherein the temperature of the aqueous mineral suspension during the dispersion is at least about 70° C.; heating the dispersion to a temperature above a glass transition temperature (Tg) of the polymer composition and increasing the pH to above 7.0; cooling the dispersion comprising the dispersed particles of the polymer composition to a temperature of from about 1° C. to about 89° C.; and recovering the particles. These particles may be substantially spherical in shape and may comprise a textured or roughened surface morphology.

The glass transition temperature or "Tg" of the polymer composition refers to the temperature at which a polymeric material transitions from a glassy state to a rubbery state. The glassy state is typically associated with a material that is, for example, brittle, stiff, rigid, or a combination thereof. In contrast, the rubbery state is typically associated with a material that is, for example, flexible and elastomeric. The glass transition temperature can be determined using a method such as Differential Scanning Calorimetry (DSC) (e.g., using the midpoint method). It will be appreciated by one of ordinary skill in the art that although individual components have single glass transition temperatures, the glass transition temperature of the polymer composition is influenced by the blend of polymers in the polymer composition (for example, the relative amounts of the polymers), the individual glass transition temperature of each, along with other factors known in the art (e.g., the Flory-Fox relationship).

The dispersion may be heated to a temperature higher than the glass transition temperature of the polymer composition, preferably, a temperature higher than the glass transition temperature and lower than the heat decomposition temperature of the polymer composition. For example, depending on the glass transition temperature of the specific polymer used, the temperature may be between about 80 to about 200° C., more preferably, between about 100° C. and about 150° C., as long as the glass transition temperature is below or within the ranges. It is contemplated, however, that any suitable temperature may be reached as long as it is greater than the glass transition temperature of the polymer composition.

The pH of the dispersion may be maintained or raised to a basic pH, for example, a pH above 7.0 (e.g., pH of 8 to 12), preferably a pH of 9.0 or above (e.g., pH of 9 to 11). The pH may be adjusted using one or more suitable bases, such as metal hydroxides (e.g., sodium, potassium, lithium, cesium or magnesium hydroxide), amine-containing bases (e.g., ammonium hydroxide, ethyl amine, triethyl amine), and the like. The bases may be solutions, such as aqueous solutions, or may be neat. This pH adjusting step is separate and distinct from the washing step, which occurs after the particles are formed and recovered. The pH of the dispersion is adjusted before recovering the particles, and before, during, or after heating the dispersion to a temperature above the glass transition temperature of the polymer composition.

The heating and pH adjusting step may be carried out under mixing conditions for any suitable period of time. For example, the pH may be maintained in the basic range and the dispersion may be heated to above the glass transition temperature under agitation for a period of 10 to 30 minutes, for example.

Figure 4:
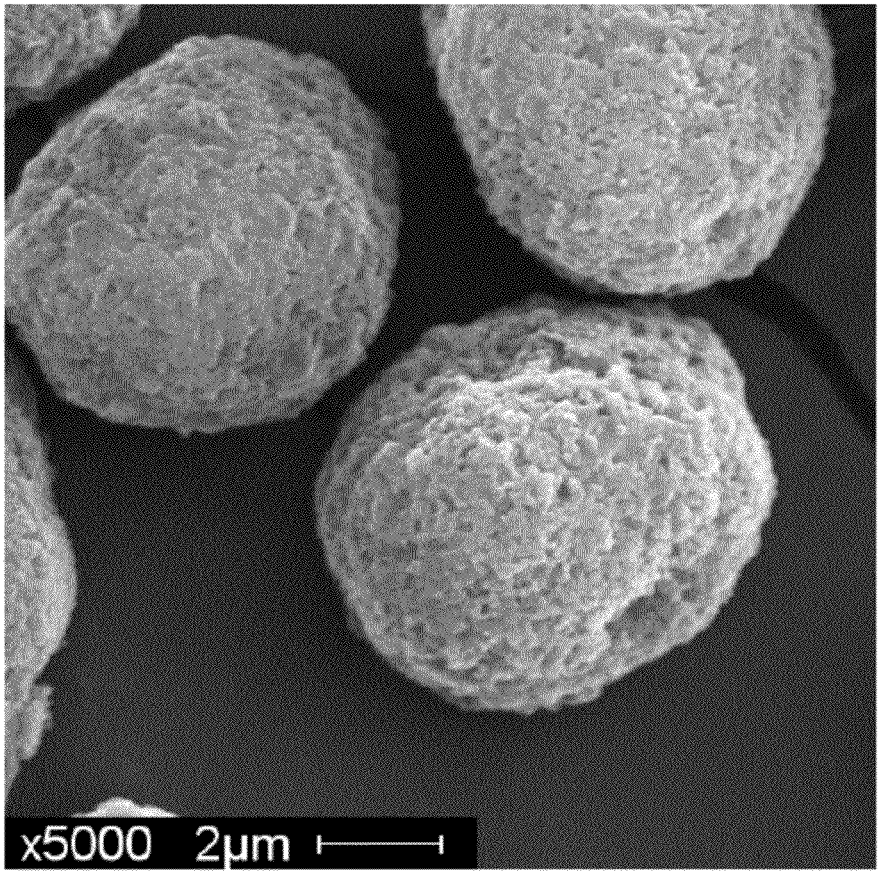
FIG. 4 is a SEM photomicrograph of toner particles having a spheroidal shape with a textured surface.

The recovered particles may be substantially spherical in shape and may comprise a textured or roughened surface morphology. FIG. 4 depicts an example of substantially spherical particles having a textured surface. As used herein, a "substantially spherical" shape denotes particles that are spherical or nearly spherical in that the length of the longest radius is approximately equal to the shortest radius of the particle. A perfect sphere would occur when the ratio of the shortest radius to the longest radius of the particle is 1:1. In one embodiment, the particles comprise a substantially spherical shape where a ratio of a shortest radius of the particles to a longest radius of the particles ranges from about 1:1 to 1:3, preferably 1:1.05 to 1:2. A substantially spherical shape may be desirable when the toner is used during the printing process. It may also be desirable that the particles are not perfectly spherical because perfectly spherical particles may have a tendency to roll and not properly function during printing operations.

Figure 5:
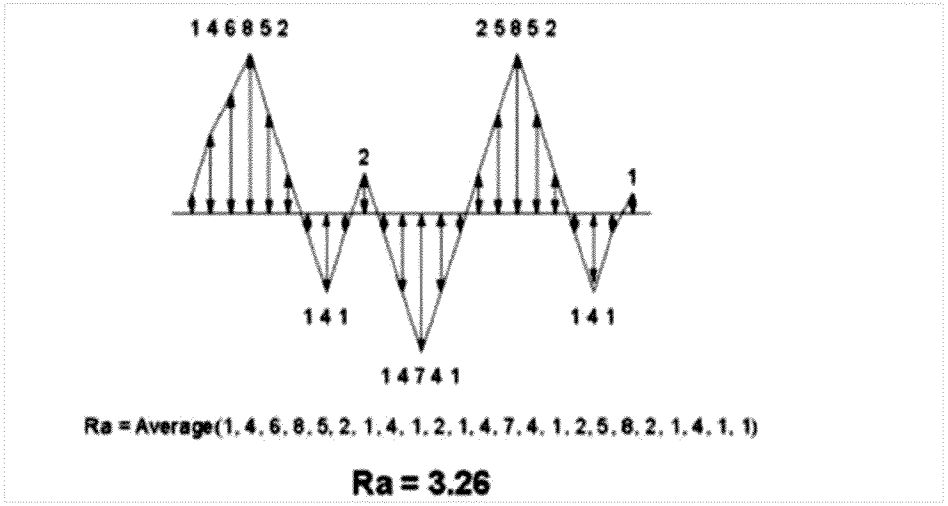
FIG. 5 graphically represents the average amplitude, Ra.

The recovered particles may comprise a textured or roughened surface morphology. As used herein, "textured" or "roughened" may be used to denote surface irregularity, porosity, or a non-uniform surface of the particles. In other words, the opposite of a smooth particle. Surface roughness may be defined by a number of different roughness parameters known in the art including average roughness ($R_a$), root mean squared roughness ($R_q$, $R_{RMS}$), maximum valley depth ($R_v$), maximum peak height ($R_p$), maximum height of the profile ($R_t$), and the like. The particle surface roughness or texture may be defined by the average roughness parameter, $R_a$, which is the most commonly used roughness value. $R_a$ is the arithmetic average height. Mathematically, $R_a$ is computed as the average distance between each roughness profile point and the mean line. As shown in FIG. 5, the average amplitude is the average length of the arrows.

In mathematical terms, this process can be represented as $$Ra = \frac{1}{n}\sum_{i=1}^{n} |y_i|$$

The surface roughness of toner particles may be measured by first generating a electron micrograph with a multi detector scanning electron microscope, such as FIB-SEM manufactured by Carl Zeiss Microscopy, International headquartered in Jena, Germany, and then importing the data into an appropriate software package. In particular, the surface roughness value, $R_a$, is computed by importing the electron micrograph into AxioVision software equipped with the KS Elispot module available from Zeiss. The roughness of the particle is determined by analysis through a technique known as water leveling. The imported image is recalibrated to a dimensional standard. Water leveling interprets the contrast values of the image and applies contour demarcations to generate a topogram. The contours of the topogram are interpreted by the software to generate the surface roughness data. The mathematics applied by the software are proprietary to Zeiss.

In an exemplary embodiment, the $R_a$ of the textured particles may range from about 5 to about 70 nm, preferably about 15 to about 60 nm. As shown in the following Table, a higher pH of the dispersion results in a higher $R_a$ value. In other words, a higher pH may be considered directly proportional to a higher degree of surface texture. Sphericity indicates how spherical the particles are, where 1.0 equals a perfect sphere.

| pH | $R_a$ (nm) | Standard Deviation (nm) | $R_a$ Range (nm) | Sphericity |
|---|---|---|---|---|
| 7-8 | 18 | 4.4 | 15-20 | 0.96 |
| 8-9 | 24 | 4.8 | 20-27 | 0.94 |
| 9-11 | 49 | 5.3 | 44-55 | 0.93 |

The roughened texture on the outer surface of the particles is obtained by the method described herein. In other words, the particles have a roughened texture when recovered from the process for producing the particles. The texture is not produced by any subsequent techniques (e.g., etching, eroding) after the particles have formed. The roughened texture on the surface of the particles may cover all or a part of the surface and may also potentially influence the interior of the particles (e.g., the porosity within the particle).

Without wishing to be bound to a particular theory, it is believed that the roughened texture may provide for increased attraction between the particles and other ingredients admixed with the particles to form the toner. In other words, other toner ingredients (e.g., charge control agents, surface active agents, and dispersants) may be deposited or coated onto the roughened surface and may be more permanently affixed thereto. For example, charge control agents may be mixed with the textured particles, once formed, to coat the surface of the particles instead of being mixed into the polymeric composition during formation of the polymeric particles. This may be advantageous because the charge control agent may be selected contemporaneously with the use of the toner, for example, prior to printing, as opposed to being preselected when the particles are formed.

(b) Smooth Surface Morphology

According to another aspect of the invention, a process for producing a colored toner having a smooth surface morphology comprises: forming a polymer composition comprising at least one polymer and a colorant, wherein the at least one polymer has a softening temperature from about 60° C. to about 160° C.; forming an aqueous mineral suspension of at least one multivalent metal phosphate; forming a dispersion by combining the polymer composition and the aqueous mineral suspension under agitation to form a solid portion comprising dispersed particles of the polymer composition, wherein the temperature of the aqueous mineral suspension during the dispersion is at least about 70° C.; and adjusting the temperature, preferably, to above the glass transition temperature of the polymer composition and adjusting the pH of the dispersion to be acidic; cooling the dispersion comprising the dispersed particles of the polymer composition to a temperature of from about 1° C. to about 89° C.; and recovering particles comprising a smooth surface.

Once the dispersion is formed, a smooth surface morphology may be obtained by maintaining or adjusting the pH of the dispersion to be acidic. The pH of the dispersion may be maintained or lowered to an acidic pH, for example, a pH below 7.0 (e.g., a pH of 4 to 6), preferably a pH of 6.0 or below (e.g., a pH of 5 to 6). The pH may be adjusted using one or more strong or weak acids, such as hydrochloric acid, nitric acid, phosphoric acid, acetic acid, propionic acid, butyric acid, phthalic acid, sulfuric acid, and mixtures thereof. The acids may be used as solutions including aqueous solutions or may be neat. This pH adjusting step is separate and distinct from the washing step, which occurs after the particles are formed and recovered. The pH of the dispersion is adjusted before recovering the particles. The pH adjusting step may be carried out under mixing conditions for any suitable period of time. For example, the pH may be maintained in the acidic range under agitation for a period of 10 to 30 minutes, for example.

The dispersion does not necessarily need to be heated to above the glass transition temperature of the polymer composition (e.g., the dispersion may be heated to a temperature lower than the glass transition temperature of the polymer composition). It may be preferred, however, to heat the dispersion to a temperature higher than the glass transition temperature of the polymer composition, preferably, a temperature higher than the glass transition temperature and lower than the heat decomposition temperature of the polymer composition.

The heating and pH adjusting step may be carried out under mixing conditions for any suitable period of time. For example, the pH may be maintained in the acidic range and the dispersion may be heated to above the glass transition temperature under agitation for a period of 10 to 30 minutes, for example. The cooling step may occur after heating and adjusting the pH of the dispersion to be acidic.

Figure 3:
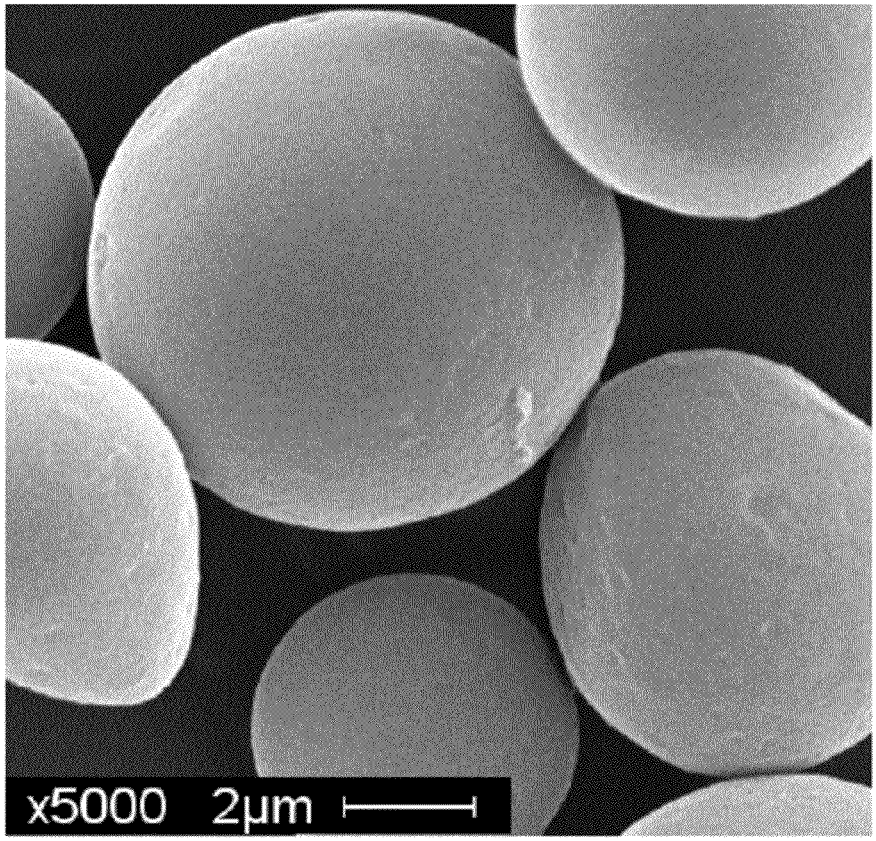
FIG. 3 is a SEM photomicrograph of toner particles having a spheroidal shape with a smooth surface.

The recovered particles may be substantially spherical in shape and may comprise a smooth surface morphology. FIG. 3 depicts an example of substantially spherical particles having a smooth surface. As used herein, "smooth" may be used to denote a particle with minimal or no roughness, unevenness, irregularities, or discontinuities in its surface.

In an exemplary embodiment, the $R_a$ of the smooth particles may be from about 0.1 to about 5 nm, preferably about 0.5 to about 3.5 nm. As discussed above, the surface roughness of the toner particles were computed using the water leveling technique using software available from Zeiss. The following Table summarizes the values for smooth particles.

| pH | $R_a$ (nm) | Standard Deviation (nm) | $R_a$ Range (nm) | Sphericity |
|---|---|---|---|---|
| 5-6 | 1.5 | 0.9 | 0.79-3.1 | 0.98 |

The smooth outer surface of the particles is obtained by the method described herein. In other words, the particles have a smooth surface when recovered from the process for producing the particles. The smooth surface is not produced by any subsequent techniques (e.g., applying a coating or the like) after the particles have formed. The smooth exterior preferably covers the entire outer surface of the particles.

Cooling Step

In the cooling step, the liquid mixture containing the dispersed solid resin particles (hereinafter also referred to as an aqueous slurry) is cooled. The aqueous slurry is cooled preferably by removing the heat source after forming the dispersion of solid resin particles and by allowing the dispersion to cool either on its own or by employing a coolant such as, for example, ice or an ice bath. The aqueous dispersion is preferably cooled under continuous stirring.

In the dispersion step, since the liquid mixture of the polymer and the aqueous dispersant solution is dispersed by heating the mixture to render the kneaded polymer composition into a molten state, the colorant-containing resin particles just after formation are in a molten state and have tackiness. In preferred embodiments, growth of the particles of the colorant-containing polymer composition does not occur in the cooling step and the colorant-containing resin particles can be cooled while maintaining the size in a state dispersed uniformly in the liquid mixture. Accordingly, a large portion of the solid toner particles in the dispersion will have a particle size of between 2.0 μm to 15.0 μm to give a volume average particle size of the generated toner of a value between about 3.0 μm and about 12 μm and a particle size distribution of less than 1.4.

When the polymer composition is dispersed in a pressurized vessel at a heating temperature of 100° C. or higher it is preferred that pressurization is continued during the cooling step. It is preferred that the pressure in the mixing vessel is returned to atmospheric pressure when the temperature of the mixture in the mixing vessel is below about 50° C. and, more preferably, when the temperature of the mixture in the mixing vessel is about 25° C.

Washing Step

In the washing step, the toner particles dispersed in the aqueous medium are cleaned after cooling to remove any impurities such as, for example, the mineral dispersant particles. Such cleaning is conducted, for example, by employing a combination of water and an acid in an amount sufficient to bring the pH of the dispersion to 3 or below under agitation, followed by rinsing with water alone. Suitable acids include inorganic acids such as, for example, HCl, $HNO_3$, $H_2PO_4$, and mixtures thereof; and organic acids such as, for example, acetic acid, propionic acid, stearic acid, citric acid, and mixtures thereof. After the pH of the dispersion has been lowered to 3 or below, the toner particles are preferably separated from the aqueous medium and washed at least once more with water. Water washing is preferably conducted repetitively till the electroconductivity of the supernatant separated by centrifugation or the like from the liquid mixture lowers to 300 μS/cm or less, preferably, 150 μS/cm or less.

Preferably, the water employed in the water washing is water having an electroconductivity of 50 μS/cm or less. Such water can be prepared, for example, by an activated carbon method, ion exchange method, distillation method or reverse osmosis method. The water washing for the toner resin particles may be conducted either batchwise or continuously. Further, while the temperature of the cleaning water is not particularly restricted, it is preferably from between about 10° C. to about 80° C.

The washing step can be conducted by adding at least one acid to the aqueous medium from the dispersion step or a separation step as described in more detail below can first be performed followed by the washing step.

Separation Step

In the separation step, the toner particles are separated and recovered from the liquid mixture in which they are contained. The toner particles can be separated from the liquid mixture in accordance with a known method and, for example, it can be conducted by filtration, sedimentation, centrifugal separation, etc.

Drying Step

In the drying step, the separated toner particles are dried and optionally classified to obtain the toner particles of the invention. Drying can be conducted in accordance with a known method such as a vacuum oven, a freeze drying method, a spray drying method, a fluid bed, or an air stream drying method.

The resultant toner particles are suitable for use as a toner. Further surface modification of the toner particles can also be conducted, if desired, by externally adding an additive such as, for example, a surface modifier to the toner particles. The surface modifier includes, for example, metal oxide particles such as silica and titanium oxide. Although the ratio of the additive used relative to the toner particles is not particularly restricted, it is preferably employed between about 0.1 to about 10 parts by weight and, more preferably, between about 0.5 and about 5 parts by weight based on 100 parts by weight of the toner particles.

Toner Particle Size

Preferably, the volume average particle size of the particles of the polymer composition obtained by the process of the present invention is less than 12 μm, and particle size distribution is less than 1.4. More preferably, the volume average particle size of the particles of the polymer composition obtained by the process of the present invention is between 3 μm and 12 μm, and particle size distribution is less than 1.4. Still more preferably, the volume average particle size of the particles obtained by the process of the present invention is between about 4.0 μm and about 9.0 μm, and particle size distribution is less than 1.4. As used herein, the distribution is a ratio of the volume average particle size (Pv) and number average particle size (Pn) of the particles. A ratio Pv/Pn=1 indicates an ideal mono-particle size distribution. To generate high quality color images, it is preferred that the Pv/Pn≤1.4. The particle size of particles according to the present invention is measured, for example, by a Coulter Particle Counter and Size Analyzer, Model Z2 fitted with a 100 μm orifice aperture tube as described in greater detail below.

The Toner and Toner Additives

As discussed above, a colored toner with a given surface morphology (e.g., rough or smooth) may be obtained by either:

(i) heating the dispersion to a temperature above a glass transition temperature (Tg) of the polymer composition and adjusting the pH of the dispersion to be basic; cooling the dispersion comprising the dispersed particles of the polymer composition to a temperature of from about 1° C. to about 89° C.; and recovering particles comprising a textured surface; or (ii) heating the dispersion to a temperature above a glass transition temperature (Tg) of the polymer composition and adjusting the pH of the dispersion to be acidic; cooling the dispersion comprising the dispersed particles of the polymer composition to a temperature of from about 1° C. to about 89° C.; and recovering particles comprising a smooth surface.

It may be desirable for the particle surface to have a roughened texture in order for the other toner additives to better coat and adhere to the particles. In other words, toner ingredients, such as charge control agents, surface active agents, and dispersants, may be deposited or coated onto the roughened surface and may be more permanently affixed to the particles.

Suitable charge control agents, which may be used to coat the particles, include, for example, those discussed above for incorporation with the polymeric composition, such as quaternary ammonium salt compounds, nigrosine compounds, organic metal complexes, chelate compounds, metal salts of salicylic acid such as zinc salicylate, and polymeric compounds obtained by homopolymerization or copolymereization of monomers having ionic groups such as sulfonic groups and amino groups.

Suitable surface active agents may include, for example, polyvinyl pyrrolidone, polyvinyl alcohol, polyacrylic acid polymer, and copolymers and combinations thereof.

Other additives and dispersants may include, but are not limited to, colloidal silica, titanium oxide, calcium phosphate, barium carbonate, calcium carbonate, aluminum oxide, and mixtures thereof.

The following examples are provided for the purpose of further illustrating the present invention but are by no means intended to limit the same.

EXAMPLES

Toner Particle Size Measurement

The particle size of toner particles can be measured by a Coulter Particle Counter and Size Analyzer, Model Z2 fitted with a 100 μm orifice aperture tube. The instrument allows for particle size measurement with a range of 3X at once, wherein X is the selected lower end of the range to be measured. Thus, two measurements were performed for each sample, one between 3 μm to 9 μm, the other between 9 μm and 27 μm. The raw data of particle counts were imported to a Microsoft Excel™ spreadsheet. The sample vial was shaken in between the two measurements to prevent particle settlement. Volume average particle size (Pv) and number average particle size (Pn) were calculated by the Excel™ spreadsheet. The ratio of Pv/Pn is an indicator of particle size distribution. Pv/Pn=1 indicates an ideal mono-particle size distribution. To generate high quality color images, it is desirable to achieve a particle size distribution of Pv/Pn<1.4.

All slurry samples were filtered through a 45 mm filter before performing the measurement to remove the minute amount of extraneous large particles generated by the process due to imperfection of the mechanical mixing system.

Example 1

With Crystal Growth Inhibitor 425 g of Diacron® ER-502 polyester (supplied by Dianal America, Pasadena, Tex.) with a softening temperature of 110° C. and a small amount of gel content, 30 g of pigment blue 15:3, 25 g of bisphenol-A type epoxy resin, and 20 g of Montan wax were mixed in a two-roll mill, and pulverized into 20 mesh coarse powders. The material is designated as Coarse Polymer Powder.

1280 g of de-ionized water was introduced into a 1 gallon vessel fitted with a Kady® Lab Mill and stirred at a motor speed of 15 Hz. 17.2 g of trisodium phosphate decahydrate, 2 g of citric acid, and 1 g of sodium pyrophosphate were then added to the vessel. The temperature of the vessel was increased to 98° C. 133 g of 3.5% aqueous solution of calcium chloride was then titrated into the vessel. 10 minutes after completion of the calcium chloride addition, a sample was taken from the vessel and pH of the sample was measured to be 7.8. The motor speed of Kady® Mill was then increased to 45 Hz, and 200 g of Coarse Polymer Powder was introduced into the vessel. 30 minutes after introduction of the Coarse Polymer Powder, the vessel was rapidly cooled to 70° C. and the motor speed of Kady® Mill was reduced to 20 Hz while cooling continued until the temperature reached 25° C. The resulting slurry was filtered through a 45 μm filter, and the particle size was measured by Coulter Counter® Z2. Volume average particle size, Pv, was 6.6 μm. Pv/Pn was 1.32. The resulting fine particle slurry was then washed with hydrochloric acid solution, followed by additional cycles of de-ionized water washing and filtration, and finally was dried to become a Fine Powder. 0.5% of Aerosil® R-972 and 0.5% of Aerosil® RX50 fumed silica (Supplied by Degussa, Parsippany, N.J.) based on the Fine Powder was added to the Fine Powder in a Henschel Mixer™. A color toner was obtained.

Comparative Example 1

The same process of Example 1 was followed, without the addition of citric acid and sodium pyrophosphate. A poor dispersion was obtained with most of the particles having a size of between 50 to 100 μm as observed under a microscope. The particles could not be measured by Coulter Counter® because the particle would plug up the orifice of the Aperture Tube.

Example 2

The same process of Example 1 was followed, except that only 1 g of citric acid was added instead of 2 g. pH of a sample retreated 10 minutes after completion of the calcium chloride addition was measured to be 10.5. Pv was 6.9 μm, and Pv/Pn was 1.30.

Example 3

450 g Diacron® ER-535 polyester (supplied by Dianal America, Pasadena, Tex.) with a softening temperature of 99° C. with no gel content, 30 g of pigment blue 15:3, 25 g, and 20 g of Montan wax were mixed in a two-roll mill, and pulverized into a 20 mesh coarse powder. The material is designated as Coarse Polymer Powder.

In a 1 gallon vessel fitted with a Kady® Lab Mill, 1500 g of de-ionized water was introduced and stirred at a motor speed of 15 Hz. 14.3 g of trisodium phosphate decahydrate and 2 g of phthalic anhydride was then added to the vessel. The temperature of the vessel was increased to 60° C. and 110 g of a 3.5% aqueous solution of calcium chloride was titrated into the vessel. Afterward, the temperature of the vessel was increased to 98° C. and was held at 98° C. for 15 minutes. The motor speed of the Kady Mill was then increased to 45 Hz and 150 g of the Coarse Polymer Powder was introduced into the vessel. 30 minutes after introduction of the Coarse Polymer Powder, the vessel was rapidly cooled to 70° C., the motor speed of Kady® Mill was reduced to 20 Hz while cooling continued until the temperature reached 25° C. The resulting slurry was filtered through a 45 μm filter and the particle size was measured by Coulter Counter® Z2. Volume average particle size, Pv, was 7.2 μm. Pv/Pn was 1.29. The resulting fine particle slurry was then washed with hydrochloric acid solution, and followed by additional cycles of washing and filtration, and finally was dried to become a Fine Powder. 0.5% of Aerosil® R-972 and 0.5% of Aerosil® RX50 fumed silica (Supplied by Degussa, Parsippany, N.J.) based on the Fine Powder was added to the Fine Powder in a Henschel Mixer™. A color toner was obtained.

Comparative Example 3

450 g Diacron® ER-535 polyester (supplied by Dianal America, Pasadena, Tex.) with a softening temperature of 99° C. and no gel content, 30 g of pigment blue 15:3, 25 g, and 20 g of Montan wax were mixed in a two-roll mill, and pulverized into a 20 mesh coarse powder. The material is designated as Coarse Polymer Powder.

1500 g of de-ionized water was introduced into a 1 gallon vessel fitted with a Kady® Lab Mill and stirred at a motor speed of 15 Hz. 14.3 g of trisodium phosphate decahydrate was then added to the vessel. The temperature of the vessel was increased to 60° C. and 110 g of 3.5% aqueous solution of calcium chloride was titrated into the vessel. A sample, Calcium Phosphate-1 was retreated from the vessel and the pH was measured to be 11.5. Calcium Phosphate-1 appeared to be a white cloudy liquid and the calcium phosphate particles would settle to the bottom of the sample vial in less than 1 hour. Afterward, 3.5 g of citric acid was added to the vessel and the temperature of the vessel was increased to 98° C. and was held at 98° C. for 15 minutes. A sample, Calcium Phosphate-2, was retreated from the vessel and pH was measured to be 5.5. Calcium Phosphate-2 appeared to be a translucent liquid, and the calcium phosphate particles appeared to be very stable and would not settle after 1 hour of standing in the sample vial. The motor speed of the Kady® Mill was increased to 45 Hz and 150 g of Coarse Polymer Powder was introduced into the vessel. A dispersion did not form and the melted polymers fouled the vessel.

It is speculated that the calcium phosphate particles formed at pH<6 carry a different charge polarity or charge density compared with the calcium phosphate formed at pH>7.

Example 4

Magnesium Phosphate 425 g of Diacron® ER-502 polyester (supplied by Dianal America, Pasadena, Tex.) with a softening temperature of 110° C. having a small amount of gel content, 30 g of pigment blue 15:3, 25 g of epoxy resin, and 20 g of Montan wax were mixed in a two-roll mill, and pulverized into 20 mesh coarse powders. The material is designated as Coarse Polymer Powder.

1280 g of de-ionized water was introduced into a 1 gallon vessel fitted with a Kady® Lab Mill and stirred at a motor speed of 15 Hz. 17.2 g of trisodium phosphate decahydrate and 2 g of citric acid were then added to the vessel. The temperature of the vessel was increased to 98° C. and 133 g of 3.5% aqueous solution of magnesium chloride was titrated into the vessel. 10 minutes after completion of the magnesium chloride addition, a sample was taken from the vessel and pH of the sample was measured to be 7.7. The motor speed of Kady® Mill was then increased to 45 Hz, and 160 g of Coarse Polymer Powder was introduced into the vessel. 30 minutes after introduction of the Coarse Polymer Powder, the vessel was rapidly cooled to 70° C. and the motor speed of the Kady® Mill was then reduced to 20 Hz while cooling continued until the temperature reached 25° C. The resulting slurry was filtered through a 45 μm filter, and the particle size was measured by Coulter Counter® Z2. Because of limitations associated with the Coulter Counter® Z2, two measurements were made. The first measurement, which is represented by FIG. 1, was for particles between 2.913 microns and 9.579 microns. The second measurement was for particles between 9.574 microns and 27.08 microns. The raw data was imported to an Excel spreadsheet, and volume average particle size, Pv, and number average particle size, Pn, between 2.913 microns to 15.08 s microns was calculated by the spreadsheet. Volume average particle size, Pv, was 5.7 μm, number average particle size, and Pv/Pn was 1.33. The resulting fine particle slurry was then washed with hydrochloric acid solution, and followed by additional cycles of de-ionized water washing and filtration, and finally was dried to become a Fine Powder. 0.5% of Aerosil R-972® and 0.5% of Aerosil® RX50 fumed silica (Supplied by Degussa, Parsippany, N.J.) based on the Fine Powder was added to the Fine Powder in a Henschel Mixer™. A color toner was obtained.

Example 5

425 g of Diacron® ER-502 polyester (supplied by Dianal America, Pasadena, Tex.) with a softening temperature of 110° C. and a small amount of gel content, 30 g of pigment blue 15:3, 25 g of bisphenol-A type epoxy resin with a molecular weight of 3600, and 20 g of polyolefin wax were mixed in a two-roll mill, and pulverized into 20 mesh coarse powders. The material is designated as "Coarse Polymer Powder."

1280 g of de-ionized water was introduced into a 1 gallon vessel fitted with a Kady® Lab Mill and stirred at a motor speed of 15 Hz. 40 g of trisodium phosphate decahydrate, 2 g of citric acid, and 1 g of sodium pyrophosphate were then added to the vessel. The temperature of the vessel was increased to 98° C. 300 g of 3.5% aqueous solution of calcium chloride was then titrated into the vessel. 15 minutes after completion of the calcium chloride addition, a sample was taken from the vessel and the pH of the sample was measured to be 7.8. The motor speed of Kady® Mill was then increased to 45 Hz, and 500 g of Coarse Polymer Powder was introduced into the vessel. 35 minutes after introduction of the Coarse Polymer Powder, the vessel was rapidly cooled to 70° C. and the motor speed of Kady® Mill was reduced to 20 Hz while cooling continued until the temperature reached 25° C. The particle size of the resulting slurry was measured by a Coulter Counter® Z2. The volume average particle size, Pv, was 6.6 μm. The Pv/Pn was 1.27. The resulting fine particle slurry was then washed with hydrochloric acid solution, followed by additional cycles of de-ionized water washing and filtration, and finally was dried to yield a fine powder. 0.5% of Aerosil® R-972 and 0.5% of Aerosil® RX50 (Supplied by Degussa, Parsippany, N.J.) based on the fine powder was added to the fine powder in a Henschel Mixer™. A color toner was obtained.

Example 6

The same process of Example 5 was followed, except that only 1 g of citric acid was added instead of 2 g. The pH of a sample retrieved 10 minutes after completion of the calcium chloride addition was measured to be 10.5. The Pv was 6.9 μm, and the Pv/Pn was 1.30.

Example 7

450 g Diacron® ER-535 polyester (supplied by Dianal America, Pasadena, Tex.) with a softening temperature of 99° C. with no gel content, 30 g of pigment yellow 74 25 g, and 20 g of polyolefin wax were mixed in a two-roll mill, and pulverized into a 20 mesh coarse powder. The material is designated as Coarse Polymer Powder.

In a 1 gallon vessel fitted with a Kady® Lab Mill, 1500 g of de-ionized water was introduced and stirred at a motor speed of 15 Hz. 40 g of trisodium phosphate decahydrate and 2 g of phthalic anhydride was then added to the vessel. The temperature of the vessel was increased to 60° C. and 300 g of a 3.5% aqueous solution of calcium chloride was titrated into the vessel. Afterward, the temperature of the vessel was increased to 98° C. and was held at 98° C. for 15 minutes. The motor speed of the Kady® Mill was then increased to 45 Hz and 450 g of the Coarse Polymer Powder was introduced into the vessel. 30 minutes after introduction of the Coarse Polymer Powder, the vessel was rapidly cooled to 70° C., the motor speed of Kady® Mill was reduced to 20 Hz while cooling continued until the temperature reached 25° C. The particle size of the resulting slurry was measured by a Coulter Counter® Z2. The volume average particle size, Pv, was 7.2 μm. The Pv/Pn was 1.29. The resulting fine particle slurry was then washed with hydrochloric acid solution, and followed by additional cycles of de-ionized water washing and filtration, and finally was dried to yield a fine powder. 0.75% of Aerosil® R-972 (Supplied by Degussa, Parsippany, N.J.) based on the fine powder was added to the fine powder in a Henschel Mixer™. A color toner was obtained.

Comparative Example 4

450 g Diacron® ER-535 polyester (supplied by Dianal America, Pasadena, Tex.) with a softening temperature of 99° C. and no gel content, 30 g of pigment blue 15:3, 25 g, and 20 g of polyolefin wax were mixed in a two-roll mill, and pulverized into a 20 mesh coarse powder. The material is designated as Coarse Polymer Powder.

1500 g of de-ionized water was introduced into a 1 gallon vessel fitted with a Kady® Lab Mill and stirred at a motor speed of 15 Hz. 40 g of trisodium phosphate decahydrate was then added to the vessel. The temperature of the vessel was increased to 60° C. and 300 g of 3.5% aqueous solution of calcium chloride was titrated into the vessel. A sample, Calcium Phosphate-1 was retrieved from the vessel and the pH was measured to be 11.5. Calcium Phosphate-1 appeared to be a white cloudy liquid and the calcium phosphate particles would settle to the bottom of the sample vial in less than 1 hour. Afterward, 4.0 g of citric acid was added to the vessel and the temperature of the vessel was increased to 98° C. and was held at 98° C. for 15 minutes. A sample, Calcium Phosphate-2, was retrieved from the vessel and the pH was measured to be 5.1. Calcium Phosphate-2 appeared to be a translucent liquid, and the calcium phosphate particles appeared to be very stable and would not settle after 1 hour of standing in the sample vial. The motor speed of the Kady® Mill was increased to 45 Hz and 150 g of Coarse Polymer Powder was introduced into the vessel. A dispersion did not form and the melted polymers fouled the vessel.

Without intending to be bound by a particular theory, it is speculated that the calcium phosphate particles formed at pH<6 carry a different charge polarity or charge density compared with the calcium phosphate formed at pH>7.

Example 8

Magnesium Phosphate 425 g of Diacron® ER-535 polyester (supplied by Dianal America, Pasadena, Tex.) with a softening temperature of 110° C. having a small amount of gel content, 30 g of pigment red 122, 25 g of epoxy resin, and 20 g of polyolefin wax were mixed in a two-roll mill, and pulverized into 20 mesh coarse powder. The material is designated as Coarse Polymer Powder.

1280 g of de-ionized water was introduced into a 1 gallon vessel fitted with a Kady® Lab Mill and stirred at a motor speed of 15 Hz. 40 g of trisodium phosphate decahydrate and 2 g of citric acid were then added to the vessel. The temperature of the vessel was increased to 98° C. and 300 g of 3.5% aqueous solution of magnesium chloride was titrated into the vessel. 10 minutes after completion of the magnesium chloride addition, a sample was taken from the vessel and the pH of the sample was measured to be 7.7. The motor speed of the Kady® Mill was then increased to 45 Hz, and 450 g of Coarse Polymer Powder was introduced into the vessel. 30 minutes after introduction of the Coarse Polymer Powder, the vessel was rapidly cooled to 70° C. and the motor speed of the Kady® Mill was then reduced to 15 Hz while cooling continued until the temperature reached 25° C.

The particle size of the resulting slurry was measured by a Coulter Counter® Z2. Volume average particle size, Pv, was 7.1 μm, and Pv/Pn was 1.30. The resulting fine particle slurry was then washed with hydrochloric acid solution, and followed by additional cycles of de-ionized water washing and filtration, and finally was dried to become a fine powder. 0.75% of Aerosil® R-972 fumed silica (Supplied by Degussa, Parsippany, N.J.) based on the Fine Powder was added to the Fine Powder in a Henschel Mixer™ A color toner was obtained.

Examples 9A-9C

Controlled Surface Morphology

Examples 9A-9C were prepared according to the following procedure.

Pigment Dispersion: To a blender apparatus, 880 grams of Diacron© ER-502 low gel containing polyester (supplied by Dianal America, Pasadena, Tex.) with a softening temperature of 110° C.; 60 grams of Pigment Yellow 74; 30 grams of polyolefin wax; and 30 grams of Montan wax, was charged and mixed until uniform. The composition was melt mixed on a heated two-roll mill until dispersion of the pigment was achieved. Subsequently, the thermoplastic composition was cooled and pulverized to a 20 mesh coarse powder. The material is designated as "Coarse Polymer Powder" below.

Toner Particle Preparation: 1850 grams of de-ionized water was charged to a 1 gallon pressure vessel fitted with a high speed Kady® Lab Rotor Stator Mill and was agitated with a rotor speed of 3700 rpm. While agitating, 39.6 grams of trisodium phosphate decahydrate was added to the vessel. The temperature of the vessel was increased to 60° C. and titrated with 211.4 grams of 5% aqueous calcium chloride solution followed by the addition of 2.0 grams of citric acid; 1.0 gram of sodium pyrophosphate; 3.21 grams of polyvinyl pyrrolidone; 8.57 grams of Ganex® P904LC 1-butene-N-vinylpyrrolidonecopolymer (supplied by GAF Corporation); and 3 grams of BYK®-024 silicone defoamer. The vessel temperature was increased to 95° C. and this temperature was held for 20 minutes. The rotor speed of the Kady® Mill was increased to 7000 rpm and while mixing, 800 grams of Coarse Polymer Powder was introduced to the vessel. The vessel was sealed and pressurized to 40 psi while ramping up the rotor speed to 12000 rpm. 9 grams of BYK®-024 silicone defoamer (supplied by BYK-Gardner USA, Columbia, Md.) was introduced to the vessel during the next 45 minutes to control foaming.

With respect to Example 9A, the vessel was cooled to 75° C., the rotor speed was reduced to 3500 rpm and Sample 9A was removed.

For Example 9B, the composition was titrated in the vessel with 1.8% of hydrochloric acid to achieve a pH of 5.5 and mixing continued for 15 minutes prior to removing Sample 9B.

In Example 9C, the temperature was increased to 90° C., and the pH was adjusted to 10 using a 20% aqueous solution of potassium hydroxide. Mixing of the composition continued at 90° C. for a period of 20 minutes. The batch was cooled to 25° C. and Sample 9C was removed.

Each of the resulting samples was filtered through a 45 μm filter and washed with a hydrochloric acid solution, followed by additional washing cycles with de-ionized water. After drying, the fine powder obtained was combined with 1.5% of Aerosil® R-972 fumed silica and 0.5% of Aerosil® RX50 fumed silica (silica powder supplied by Degussa, Parsippany, N.J.) in a Henschel Mixer™ to yield a color toner.

Finished product analysis: The particle size of the washed products were measured prior to adding the silica using a Coulter Counter® Z2. The volume average particle size, Pv, was determined to be 5.5 μm. Pv/Pn was 1.29.

Figure 2:
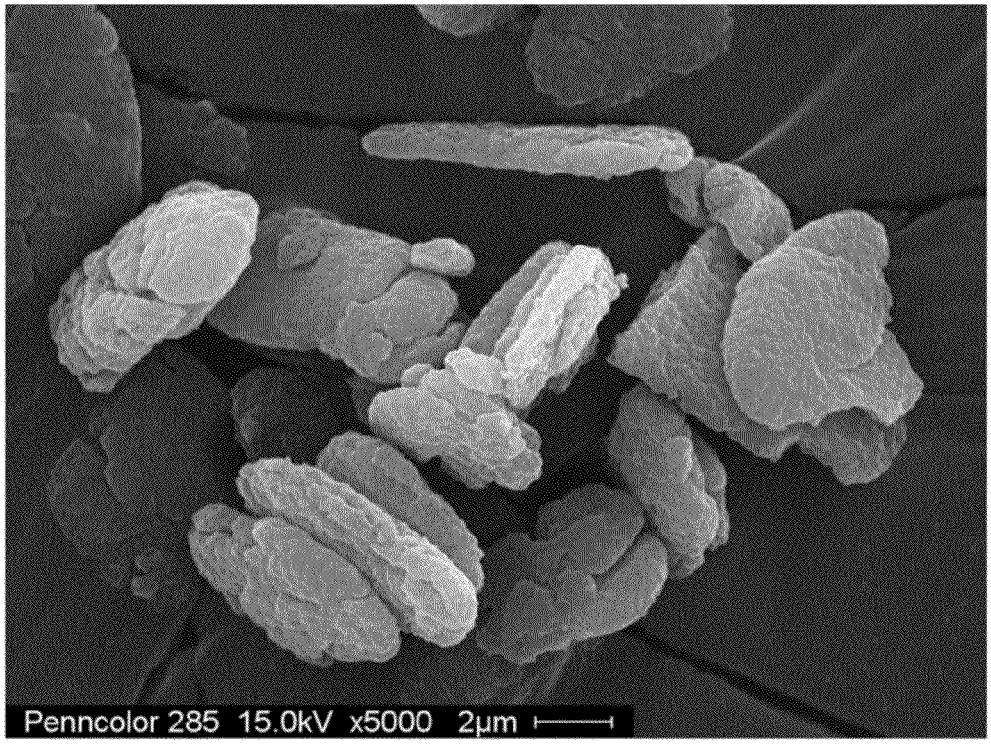
FIG. 2 is a SEM photomicrograph of toner particles having a non-spherical rod and plate-like shape.

The SEM (scanning electron microscope) photomicrograph shown in FIG. 2 shows that sample 9A has a non-spherical rod and plate-like shape. Samples 9B and 9C shown in FIGS. 3 and 4, respectively, are substantially spheroidal. The SEM photomicrograph in FIG. 3 shows particles from sample 9B are spheroidal with a smooth surface. The SEM photomicrograph in FIG. 4, on the other hand, shows particles from sample 9C are spheroidal with a textured surface.

As discussed above, the surface roughness of the toner particles were computed using the water leveling technique by importing the electron micrographs into AxioVision software equipped with the KS Elispot module available from Zeiss. The following Table summarizes the results of the surface measurements obtained.

| | pH | $R_a$ (nm) | Standard Deviation (nm) | $R_a$ Range (nm) | Sphericity |
|---|---|---|---|---|---|
| Sample 9B (Smooth) | 5-6 | 1.5 | 0.9 | 0.79-3.1 | 0.98 |
| Sample 9C (Textured) | 9-11 | 49 | 5.3 | 44-55 | 0.93 |

The foregoing examples and description of the preferred embodiments should be taken as illustrating, rather than as limiting the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

The invention claimed is:

1. A process for producing a colored toner comprising:

forming a polymer composition comprising at least one polymer and a colorant, wherein the at least one polymer has a softening temperature from about 60° C. to about 160° C.;

forming an aqueous mineral suspension of at least one multivalent metal phosphate;

forming a dispersion by combining the polymer composition and the aqueous mineral suspension under agitation to form a solid portion comprising dispersed particles of the polymer composition, wherein the temperature of the aqueous mineral suspension during the dispersion is at least about 70° C.;

heating the dispersion to a temperature above a glass transition temperature (Tg) of the polymer composition and increasing the pH to above 7.0;

cooling the dispersion comprising the dispersed particles of the polymer composition; and recovering the particles.

2. A process according to claim 1, wherein the pH is increased to 9.0 or above.

3. A process according to claim 1, wherein the particles comprise a textured surface.

4. A process according to claim 1, wherein the particles comprise an average surface roughness, Ra, of about 15 to about 55 nm.

5. A process according to claim 1, wherein the particles comprise a substantially spherical shape where a ratio of a shortest radius of the particles to a longest radius of the particles ranges from about 1:1 to 1:3.

6. A process according to claim 1, wherein the recovered particles are combined with a powder selected from the group consisting of colloidal silica, titanium oxide, calcium phosphate, barium carbonate, calcium carbonate, aluminum oxide, and mixtures thereof.

7. A process according to claim 6, wherein the recovered particles are combined with a surface active agent selected from the group consisting of polyvinyl pyrrolidone, polyvinyl alcohol, polyacrylic acid polymer, copolymers and combinations thereof.

8. The process of claim 1, wherein the volume average particle size of the recovered particles is less than 12 μm, and particle size distribution is less than 1.4.

9. The process of claim 1 wherein the volume average particle size is between about 4.0 μm and about 9.0 μm.

10. A process according to claim 1, wherein forming the aqueous mineral suspension of at least one multivalent metal phosphate occurs by contacting a water-soluble salt of the multivalent metal with an aqueous solution comprising:

a water-soluble phosphate salt; and at least one crystal growth inhibitor selected from the group consisting of: an organic polycarboxylic acid or a salt thereof, a pyrophosphate salt, phosphonic acid or a salt thereof, citric acid, L-Serine, 1,2-dihydroxy-1,2-bis(dihydroxyphosphonyl)ethane, and a Zn2+ salt, to precipitate the at least one multivalent metal phosphate, wherein the pH of the aqueous mineral suspension is from 5.5 to 14.

11. The process of claim 10, wherein the crystal growth inhibitor includes at least the organic polycarboxylic acid and the organic polycarboxylic acid is selected from the group consisting of: phthalic acid, isophthalic acid, terephthalic acid, trimelitic acid, citric acid, anhydrides, polyacrylic acid and salts thereof.

12. The process of claim 10, wherein the aqueous solution during the step of forming an aqueous mineral suspension is at a temperature of from about 30° C. to about 60° C.

13. The process of claim 1, wherein the metal of the at least one multivalent metal phosphate is at least one of calcium and magnesium.

14. The process of claim 1, wherein the at least one polymer includes one or more polymers comprising polyesters, polyurethanes, styrene-acrylic copolymers, epoxy-containing polymers, polystyrene-acrylate polymers, and combinations thereof.

15. The process of claim 1, wherein the polymer composition further comprises at least one of a wax and a charge control agent.

16. The process of claim 1 further comprising a washing step prior to recovering the particles, the washing step comprising adding an acid to the aqueous mineral suspension comprising the dispersed particles to bring the pH of the aqueous mineral suspension to less than about 2.

17. A method of producing a colored toner with a given surface morphology comprising:

forming a polymer composition comprising at least one polymer and a colorant, wherein the at least one polymer has a softening temperature from about 60° C. to about 160° C.;

forming an aqueous mineral suspension of at least one multivalent metal phosphate;

forming a dispersion by combining the polymer composition and the aqueous mineral suspension under agitation to form a solid portion comprising dispersed particles of the polymer composition, wherein the temperature of the aqueous mineral suspension during the dispersion is at least about 70° C.; and either (i) heating the dispersion to a temperature above a glass transition temperature (Tg) of the polymer composition and adjusting the pH of the dispersion to be basic; cooling the dispersion comprising the dispersed particles of the polymer composition; and recovering particles comprising a textured surface; or (ii) heating the dispersion to a temperature above a glass transition temperature (Tg) of the polymer composition and adjusting the pH of the dispersion to be acidic; cooling the dispersion comprising the dispersed particles of the polymer composition; and recovering particles comprising a smooth surface.

18. The process of claim 17, wherein particles comprising a smooth surface are formed by adjusting the pH using an acid selected from the group consisting of hydrochloric acid, nitric acid, phosphoric acid, acetic acid, propionic acid, butyric acid, phthalic acid, sulfuric acid, and mixtures thereof.

19. The process of claim 17, wherein particles comprising a textured surface are formed by adjusting the pH using a base selected from the group consisting of potassium hydroxide, ammonium hydroxide, ethyl amine, triethyl amine, sodium hydroxide, and mixtures thereof.

* * * * *